US009548530B2

(12) United States Patent
Kubo et al.

(10) Patent No.: US 9,548,530 B2
(45) Date of Patent: Jan. 17, 2017

(54) ANTENNA

(71) Applicant: NOISE LABORATORY CO., LTD., Kanagawa (JP)

(72) Inventors: Takayuki Kubo, Kanagawa (JP); Takeshi Ishida, Kanagawa (JP); Toru Uno, Tokyo (JP); Taro Yamasaki, Tokyo (JP); Hisashi Morishita, Kanagawa (JP); Masao Sakuma, Kanagawa (JP); Akihiko Nojima, Aichi (JP); Hiroki Keino, Aichi (JP); Keigo Yuba, Aichi (JP)

(73) Assignees: NOISE LABORATORY CO., LTD., Kanagawa (JP); TOYOTA MOTOR CORPORATION, Aichi-ken (JP)

( * ) Notice: Subject to any disclaimer, the term of this patent is extended or adjusted under 35 U.S.C. 154(b) by 0 days.

(21) Appl. No.: 14/760,006

(22) PCT Filed: Jan. 23, 2014

(86) PCT No.: PCT/JP2014/051344
§ 371 (c)(1),
(2) Date: Jul. 9, 2015

(87) PCT Pub. No.: WO2014/115796
PCT Pub. Date: Jul. 31, 2014

(65) Prior Publication Data

US 2015/0357706 A1 Dec. 10, 2015

(30) Foreign Application Priority Data

Jan. 24, 2013 (JP) ..... 2013-011365
Jan. 22, 2014 (JP) ..... 2014-009288

(51) Int. Cl.
*H01Q 1/48* (2006.01)
*H01Q 1/38* (2006.01)
*H01Q 9/40* (2006.01)

(52) U.S. Cl.
CPC ..... *H01Q 1/38* (2013.01); *H01Q 1/48* (2013.01); *H01Q 9/40* (2013.01)

(58) Field of Classification Search
CPC ..... H01Q 1/38; H01Q 1/48; H01Q 9/40
(Continued)

(56) References Cited

U.S. PATENT DOCUMENTS 6,809,687 B2 * 10/2004 Yuanzhu ..... H01Q 1/38 343/700 MS
7,262,739 B2 * 8/2007 Chen ..... H01Q 1/362 343/700 MS (Continued)

FOREIGN PATENT DOCUMENTS

JP 2009-171583 7/2009
JP 2012-004714 1/2012
JP 2012-195713 10/2012

*Primary Examiner* — Khai M Nguyen
(74) *Attorney, Agent, or Firm* — Clark & Brody

(57) ABSTRACT

[Problem to be Solved]
To provide an antenna which can be used in a wide band.
[Solution]
An antenna 10A includes a dielectric substrate 11, an unbalanced power supply member 12 having a non-power supply unit 23 and a power supply unit 24, a resonance conductor 13 having a connection area 26, a first resonance area 27 and a second resonance area 28, a grounding conductor 14 having a first ground area 32 and a second ground area 33, and a radiation conductor 15 having a first radiation area 37 and a second radiation area 38. At the antenna 10A, first to third radiation stepped portions 42*a* to 42*c* are formed at a first rear end portion 41 of the second radiation area 38, and
(Continued)

first to third radiation stepped portions 44*a* to 44*c* are formed at a second rear end portion 43 of the second radiation area 38.

12 Claims, 13 Drawing Sheets

(58) Field of Classification Search
USPC ..... 343/848, 846, 700 MS
See application file for complete search history.

(56) References Cited

U.S. PATENT DOCUMENTS

2009/0179804 A1 7/2009 Lieu
2011/0285594 A1 11/2011 Chang

* cited by examiner

ANTENNA

TECHNICAL FIELD

The present invention relates to an antenna provided with an unbalanced power supply member, a resonance conductor, a grounding conductor and a radiation conductor.

BACKGROUND ART

An antenna 100 illustrated in FIG. 15 is disclosed, the antenna 100 including an unbalanced power supply member having an outer conductor and an inner conductor as with a coaxial cable, and a plate like non-power supply element whose planar shape is molded in an H shape (see Patent Literature 1). As illustrated in FIG. 15, the antenna 100 of Patent Literature 1 includes the unbalanced power supply member 111, a resonance conductor 112, a grounding conductor 113 and a power supply element 114. The resonance conductor 112 is formed with first and second resonance conductors 120*a* and 120*b* extending forward in an axial direction of the unbalanced power supply member 111 in parallel to a power supply unit 118. The grounding conductor 113 is formed with a fixing portion 125 electrically connected to the unbalanced power supply member 111, and first and second grounding conductors 126*a* and 126*b* extending backward in the axial direction from the first and second resonance conductors 120*a* and 120*b* in parallel to a non-power supply unit 119. The power supply element 114 has a predetermined area, extends forward in the axial direction, and is electrically connected to a central conductor 115 of the unbalanced power supply member 111 which constitutes the power supply unit 118.

CITATION LIST

Patent Literature

[Patent Literature 1]
Japanese Patent Laid-Open No. 2012-195713

SUMMARY OF INVENTION

Technical Problem

The antenna 100 disclosed in Patent Literature 1 can provide a wideband and high gain and can freely and finely adjusts a use frequency band. Specifically, in the antenna 100, a use frequency is approximately 2.0 GHz to approximately 4.0 GHz, and a VSWR (voltage standing wave ratio) is 2 or less. However, in the antenna 100 disclosed in Patent Literature 1, a lower limit frequency can neither be lowered to a lower frequency band (for example, 700 MHz) in a state where a wide band is maintained while a size of the antenna is kept small, nor the VSWR can be made 2 or less in a full band.

An object of the present invention is to provide an antenna which is capable of transmitting or receiving a radio wave in the full band among frequency bands (fractional bandwidth) which can be used, and the antenna which can be used in a wide band. Another object of the present invention is to provide an antenna which is capable of transmitting or receiving a radio wave in a wide frequency band, which can provide a high gain in a band between 700 MHz and 3.2 GHz, and which has a VSWR of 2 or less in a state where a size of the antenna is kept small.

Solution to Problem

An antenna according to the present invention for solving the above-described problem includes a dielectric substrate having predetermined permittivity and having first and second regions sectioned by a central axial line dividing a width dimension, an unbalanced power supply member located on the central axial line and having a non-power supply unit and a power supply unit, the non-power supply unit extending in an axial direction and having predetermined length, and the power supply unit extending forward in the axial direction from the non-power supply unit, a resonance conductor molded into a plate shape having a predetermined area and fixed on one face of the dielectric substrate, a grounding conductor molded into a plate shape having a predetermined area, fixed on one face of the dielectric substrate and continuously coupled to the resonance conductor, and a radiation conductor molded into a plate shape having a predetermined area, fixed on one face of the dielectric substrate, and electrically connected to the power supply unit, and the resonance conductor has a connection area electrically connected to the unbalanced power supply member, a first resonance area coupled to the connection area, located in a first region of the dielectric substrate, and extending in the axial direction while separating outward in a width direction from the unbalanced power supply member by a predetermined dimension, and a second resonance area coupled to the connection area, located in a second region of the dielectric substrate, and extending in the axial direction while separating outward in the width direction from the unbalanced power supply member by a predetermined dimension, the grounding conductor has a first ground area located in the first region of the dielectric substrate, and extending backward in the axial direction from the first resonance area while separating outward in the width direction from the unbalanced power supply member by a predetermined dimension, and a second ground area located in the second region of the dielectric substrate, and extending backward in the axial direction from the second resonance area while separating outward in the width direction from the unbalanced power supply member by a predetermined dimension, the radiation conductor has a first radiation area located between the first and the second resonance areas and extending forward in the axial direction from the connection area of the resonance conductor, a rear end portion of the first radiation area being connected to the power supply unit, and a second radiation area extending forward in the axial direction from a front end portion of the first radiation area, a width dimension of the second radiation area being greater than a width dimension of the first radiation area, a plurality of radiation stepped portions denting stepwise forward in the axial direction toward outward in the width direction from the central axial line are formed at a first rear end portion of the second radiation area, facing the front end portion of the first resonance area, and a plurality of radiation stepped portions denting stepwise forward in the axial direction toward outward in the width direction from the central axial line are formed at a second rear end portion of the second radiation area, facing a front end portion of the second resonance area.

As one example of the antenna according to the present invention, the radiation stepped portions formed at the first rear end portion of the second radiation area and the radiation stepped portions formed at the second rear end portion of the second radiation area have a first radiation stepped portion located at a side of the central axial line and denting forward in the axial direction from the first and second rear end portions, a second radiation stepped portion located outward in a width direction of the first radiation stepped portion and denting forward in the axial direction from the first radiation stepped portion, and a third radiation stepped portion located outward in a width direction of the second radiation stepped portion and tilting so as to gradually separate from the central axial line.

As another one example of the antenna according to the present invention, a plurality of resonance stepped portions denting stepwise backward in the axial direction toward outward in the width direction from the central axial line are formed at the front end portion of the first resonance area, and a plurality of resonance stepped portions denting stepwise backward in the axial direction toward outward in the width direction from the central axial line are formed at the front end portion of the second resonance area.

As another example of the antenna according to the present invention, the resonance stepped portions formed at the front end portion of the first resonance area and the resonance stepped portions formed at the front end portion of the second resonance area have a first resonance stepped portion located at a side of the central axial line and denting backward in the axial direction from the front end portions of the resonance areas, a second resonance stepped portion located outward in a width direction of the first resonance stepped portion and denting backward in the width direction from the first resonance stepped portion, and a third resonance stepped portion located outward in a width direction of the second resonance stepped portion and denting backward in the axial direction from the second resonance stepped portion.

As another example of the antenna according to the present invention, a plurality of attenuating stepped portions denting stepwise forward in the axial direction toward outward in the width direction from the central axial line are formed at a rear end portion of the first ground area, and a plurality of attenuating stepped portions denting stepwise forward in the axial direction toward outward in the width direction from the central axial line are formed at the rear end portion of the second ground area.

As another example of the antenna according to the present invention, the attenuating stepped portions formed at the rear end portion of the first ground area and the attenuating stepped portions formed at the rear end portion of the second ground area have a first attenuating stepped portion located at a side of the central axial line and denting forward in the axial direction from the rear end portions of the resonance areas and a second attenuating stepped portion located outward in a width direction of the first attenuating stepped portion and denting forward in the axial direction from the first attenuating stepped portion.

As another example of the antenna according to the present invention, at the dielectric substrate extending between the front end portion of the first resonance area and the first rear end portion of the second radiation area, a first slit located near the radiation stepped portions and extending so as to gradually separate from the central axial line toward forward in the axial direction is formed, or a plurality of first through holes located near the radiation stepped portions and aligned so as to gradually separate from the central axial line toward forward in the axial direction are formed, and at the dielectric substrate extending between the front end portion of the second resonance area and the second rear end portion of the second radiation area, a second slit located near the radiation stepped portions and extending so as to gradually separate from the central axial line toward forward in the axial direction is formed, or a plurality of second through holes located near the radiation stepped portions and aligned so as to gradually separate from the central axial line toward forward in the axial direction are formed.

As another example of the antenna according to the present invention, at the dielectric substrate extending between the front end portion of the first resonance area and the first rear end portion of the second radiation area, a third slit located near the resonance stepped portions and extending so as to gradually separate from the central axial line toward backward in the axial direction is formed, or a plurality of third through holes located near the resonance stepped portions and aligned so as to gradually separate from the central axial line toward backward in the axial direction are formed, and at the dielectric substrate extending between the front end portion of the second resonance area and the second rear end portion of the second radiation area, a fourth slit located near the resonance stepped portions and extending so as to gradually separate from the central axial line toward backward in the axial direction is formed, or a plurality of fourth through holes located near the resonance stepped portions and aligned so as to gradually separate from the central axial line toward backward in the axial direction are formed.

As another example of the antenna according to the present invention, a first void portion where the dielectric substrate does not exist is formed between the front end portion of the first resonance area and the first rear end portion of the second radiation area, and a second void portion where the dielectric substrate does not exist is formed between the front end portion of the second resonance area and the second rear end portion of the second radiation area.

As another example of the antenna according to the present invention, the first resonance area located in the first region and the second resonance area located in the second region are symmetric with respect to the central axial line, the first ground area located in the first region and the second ground area located in the second region are symmetric with respect to the central axial line, and the first and the second radiation areas located in the first region and the first and the second radiation areas located in the second region are symmetric with respect to the central axial line.

As another example of the antenna according to the present invention, the unbalanced power supply member is formed with a first conductor extending in the axial direction, an insulator covering an outer periphery of the first conductor, and a second conductor covering an outer periphery of the insulator and extending in the axial direction, the non-power supply unit is formed with the first and the second conductors and the insulator, the power supply unit is formed with the first conductor, and the connection area of the resonance conductor is electrically connected to the second conductor.

As another example of the antenna according to the present invention, a length dimension in the axial direction of the grounding conductor falls within a range between 10 and 15 cm, and is set at length of approximately ¼ wavelength of 700 MHz.

Advantageous Effects of Invention

According to an antenna according to the present invention, because a plurality of radiation stepped portions which dent stepwise forward in the axial direction are formed at the first and the second rear end portions of the second radiation area, a high frequency current of substantially the same direction flows between the plurality of radiation stepped portions of the first and the second rear end portions of the second radiation area and the front end portions of first and second resonance areas of the resonance conductor, the radiation stepped portions of the second radiation area fixed at the dielectric substrate having predetermined permittivity and the front end portions of the first and the second resonance areas resonate at a plurality of points via the high frequency current of substantially the same direction, a high frequency current induced at the first radiation area fixed at the dielectric substrate and a high frequency current induced at the first and the second resonance areas resonate, while a high frequency current induced at the first and the second ground areas of the grounding conductor fixed at the dielectric substrate and a high frequency current induced at the non-power supply unit resonate, so that it is possible to obtain a plurality of resonance frequencies of different bands. The antenna can obtain a plurality of resonance frequencies of different bands, and because the obtained plurality of resonance frequencies are continuously adjacent to each other, and the resonance frequencies partly overlap with each other, it is possible to drastically expand a use frequency band at the antenna. The antenna can obtain a high gain whose VSWR (voltage standing wave ratio) is 2 or less, and can transmit or receive a radio wave in a full band among frequency bands (fractional bandwidths) which can be used, and the antenna can be used in a wide band, and can transmit or receive a radio wave of a wide band only with one antenna.

In the antenna in which the first and the second rear end portions of the second radiation area have the first radiation stepped portion which is located at a side of the central axial line, the second radiation stepped portion which is located outward in a width direction of the first radiation stepped portion and a third radiation stepped portion which is located outward in a width direction of the second radiation stepped portion, a high frequency current of substantially the same direction flows between the first to the third radiation stepped portions of the first and the second rear end portions of the second radiation area and the front end portions of the first and the second resonance areas of the resonance conductor, the first to the third radiation stepped portions and the front end portions of the first and the second resonance areas resonate at a plurality of points via the high frequency current of substantially the same direction, a high frequency current induced at the first radiation area and a high frequency current induced at the first and the second resonance areas resonate, while a high frequency current induced at the first and the second ground areas and a high frequency current induced at the non-power supply unit resonate, so that it is possible to obtain a plurality of resonance frequencies of different bands. Because the resonance frequencies are continuously adjacent to each other and partly overlap with each other, the antenna can secure a wide use frequency band.

In the antenna in which the plurality of resonance stepped portions are formed at the front end portion of the first resonance area, and the plurality of resonance stepped portions are formed at the front end portion of the second resonance area, a high frequency current of substantially the same direction flows between the plurality of radiation stepped portions of the second radiation area and the plurality of resonance stepped portions of the first and the second resonance areas, the radiation stepped portions and the resonance stepped portions resonate at a plurality of points via the high frequency current of substantially the same direction, a high frequency current induced at the first radiation area and a high frequency current induced at the first and the second resonance areas resonate, while a high frequency current induced at the first and the second ground areas and a high frequency current induced at the non-power supply unit resonate, so that it is possible to obtain a plurality of resonance frequencies of different bands. Because the resonance frequencies are continuously adjacent to each other and partly overlap with each other, the antenna can secure a wide use frequency band.

In the antenna in which the resonance stepped portions of the first and the second resonance areas have the first resonance stepped portion located at a side of the central axial line, the second resonance stepped portion located outward in the width direction of the first resonance stepped portion, and the third resonance stepped portion located outward in the width direction of the second resonance stepped portion, a high frequency current of substantially the same direction flows between the first to the third radiation stepped portions of the first and the second rear end portions of the second radiation area and the first to the third resonance stepped portions of the front end portions of the first and the second resonance areas, the first to the third radiation stepped portions and the first to the third resonance stepped portions resonate at a plurality of points via the high frequency current of substantially the same direction, a high frequency current induced at the first radiation area and a high frequency current induced at the first and the second resonance areas resonate, while a high frequency current induced at the first and the second ground areas and a high frequency current induced at the non-power supply unit resonate, so that it is possible to obtain a plurality of resonance frequencies of different bands. Because the resonance frequencies are continuously adjacent to each other and partly overlap with each other, the antenna can secure a wide use frequency band.

In the antenna in which the plurality of attenuating stepped portions are formed at the rear end portion of the first ground area and the plurality of attenuating stepped portions are formed at the rear end portion of the second ground area, when a high frequency current flows at the rear end portions of the first and the second ground areas, although the high frequency current flows through a chassis and a connection cable of a transceiver connected to the antenna, which affects and changes a radiation pattern of a radio wave and a gain at the antenna, because it is possible to attenuate or block the radio wave by the plurality of attenuating stepped portions formed at the rear end portions of the first and the second ground areas, the high frequency current does not flow through the chassis and the connection cable of the transceiver, so that it is possible to prevent change of the radiation pattern of the radio wave and the gain and secure a radiation pattern and a gain at the antenna as designed.

In the antenna in which the attenuating stepped portions of the first and the second ground areas have the first attenuating stepped portion located at a side of the central axial line, and the second attenuating stepped portion located outward in the width direction of the first attenuating stepped portion, because it is possible to attenuate or block a radio wave by the first and the second attenuating stepped portions formed at the rear end portions of the first and the second ground areas, a high frequency current does not flow through the chassis and the connection cable of the transceiver, so that it is possible to prevent change of the radiation pattern of the radio wave and the gain at the antenna and secure a radiation pattern and a gain at the antenna as designed.

In the antenna in which the first slit or the plurality of first through holes located near the radiation stepped portion is formed at the dielectric substrate which extends between the front end portion of the first resonance area and the first rear end portion of the second radiation area, and the second slit or the plurality of second through holes located near the radiation stepped portion is formed at the dielectric substrate which extends between the front end portion of the second resonance area and the second rear end portion of the second radiation area, because slits or through holes located near the radiation stepped portion are formed at the dielectric substrate, coupling capacitance of the dielectric substrate which extends between the front end portions of the first and the second resonance areas and the first and the second rear end portions of the second radiation area can be reduced, so that it is possible to reduce a rate at which heat is dissipated instead of a radio wave being generated, and drastically improve tan δ as an element of radio wave conversion efficiency at the antenna. As a result of slits or through holes being formed at the dielectric substrate near the radiation stepped portion, the antenna can increase a radiation gain and can emit a ratio wave farther.

In the antenna in which the third slit or the plurality of third through holes located near the resonance stepped portion is formed at the dielectric substrate which extends between the front end portion of the first resonance area and the first rear end portion of the second radiation area, and the fourth slit or the plurality of fourth through holes located near the resonance stepped portion is formed at the dielectric substrate which extends between the front end portion of the second resonance area and the second rear end portion of the second radiation area, because slits or through holes located near the resonance stepped portion are formed at the dielectric substrate, coupling capacitance of the dielectric substrate which extends between the front end portions of the first and the second resonance areas and the first and the second rear end portions of the second radiation area can be reduced, so that it is possible to reduce a rate at which heat is dissipated instead of a radio wave being generated, and drastically improve tan δ as an element of radio wave conversion efficiency at the antenna. As a result of slits or through holes being formed at the dielectric substrate near the resonance stepped portion, the antenna can increase a radiation gain and can emit a radio wave farther.

In the antenna in which the first void portion where the dielectric substrate does not exist is formed between the front end portion of the first resonance area and the first rear end portion of the second radiation area, and the second void portion where the dielectric substrate does not exist is formed between the front end portion of the second resonance area and the second rear end portion of the second radiation area, because the first and the second void portions where the dielectric substrate does not exist are respectively formed between the front end portion of the first resonance area and the first rear end portion of the second radiation area, and between the front end portion of the second resonance area and the second rear end portion of the second radiation area, coupling capacitance between the front end portions of the first and the second resonance areas and the first and the second rear end portions of the second radiation area can be drastically reduced, so that it is possible to reduce a rate at which heat is dissipated instead of a radio wave being generated, and drastically improve tan δ as an element of radio wave conversion efficiency at the antenna. As a result of the void portions being formed, the antenna can increase a radiation gain and can emit a radio wave farther.

In the antenna in which the first resonance area located in the first region and the second resonance area located in the second region are symmetric with respect to the central axial line, the first ground area located in the first region and the second ground area located in the second region are symmetric with respect to the central axial line, and the first and the second radiation areas located in the first region and the first and the second radiation areas located in the second region are symmetric with respect to the central axial line, because the first and the second resonance areas, and the first and the second ground areas are made symmetric with respect to the central axial line, and the first and the second radiation areas located in the first region and the first and the second radiation areas located in the second region are made symmetric with respect to the central axial line, it is possible to prevent change of a radiation pattern of a radio wave which is caused by the first and the second resonance areas, the first and the second ground areas, and the first and the second radiation areas being asymmetric with respect to the central axial line, so that it is possible to secure a radiation pattern at the antenna as designed. As a result of the first and the second resonance areas, the first and the second ground areas, and the first and the second radiation areas being disposed so as to be symmetric with respect to the central axial line, the first and the second rear end portions of the second radiation area and the front end portions of the first and the second resonance areas of the resonance conductor resonate at a plurality of points at substantially the same coupling capacitance, the first radiation area and the first and the second resonance areas resonate, and the first and the second ground areas of the grounding conductor and the non-power supply unit resonate at substantially the same coupling capacitance, so that the antenna can obtain a plurality of resonance frequencies of different bands and secure a wide use frequency band.

In the antenna in which the unbalanced power supply member is formed with the first conductor, the insulating body which covers the outer periphery of the first conductor, and the second conductor which covers the outer periphery of the insulating body and which extends in the axial direction, the non-power supply unit is formed with the first and the second conductors and the insulating body, and the connection area of the resonance conductor is electrically connected to the second conductor, the second radiation area and the first and the second resonance areas resonate at a plurality of points, and the first radiation area and the first and the second resonance areas resonate, so that the antenna can obtain a plurality of resonance frequencies of different bands and can secure a wide use frequency band. As a result of the insulating body being placed between the first conductor and the second conductor, the antenna can stably maintain impedance, can prevent a short circuit between the first conductor and the second conductor of the unbalanced power supply member, and can prevent breakage of a high frequency circuit of the transceiver due to a short circuit between the conductors.

In the antenna in which the length dimension in the axial direction of the grounding conductor falls within a range between 10 and 15 cm and is set at length of approximately ¼ wavelength of 700 MHz, because the length dimension in the axial direction of the grounding conductor falls within the above-described range, the length dimension becomes length of approximately ¼ wavelength of 700 MHz, and a use frequency band at the antenna can be made to fall within a range of 700 MHz and 3.2 GHz, so that it is possible to lower a lower limit frequency to 700 MHz while the size of the antenna is kept small.

DESCRIPTION OF EMBODIMENT

Figure 1:
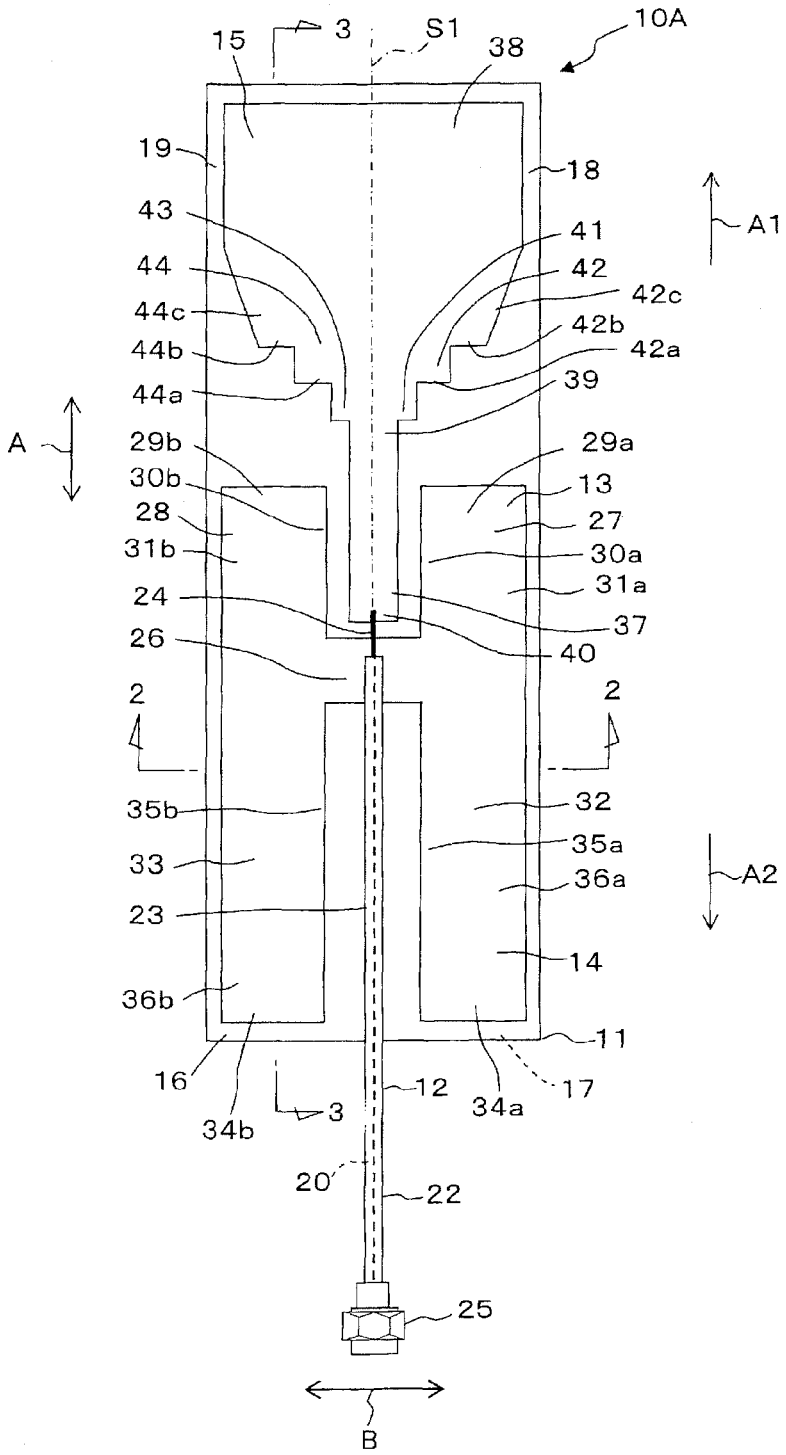
FIG. 1 is a plan view of an antenna illustrated as one example.
Figure 2:
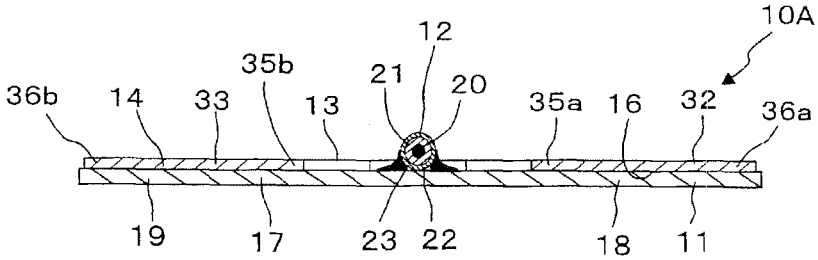
FIG. 2 is a cross-sectional diagram cut along line 2-2 in FIG. 1.
Figure 3:
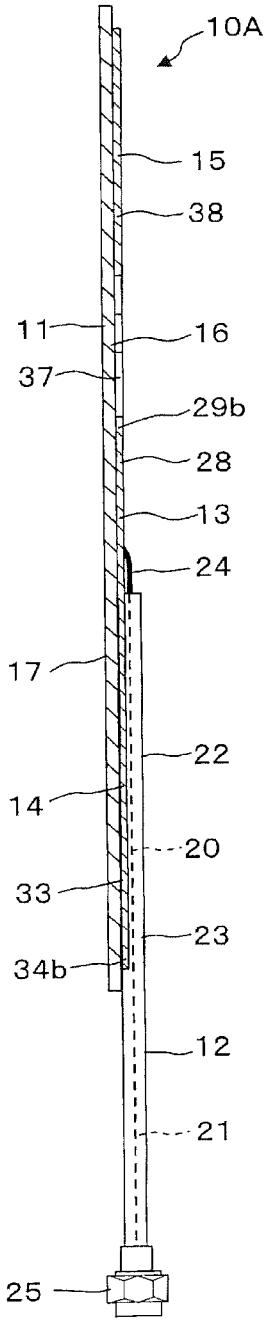
FIG. 3 is a cross-sectional diagram cut along line 3-3 in FIG. 1.

Details of an embodiment of an antenna according to the present invention will be described below with reference to the accompanying drawings such as FIG. 1 which is a plan view of an antenna 10A illustrated as one example. It should be noted that FIG. 2 is a cross-sectional diagram cut along line 2-2 in FIG. 1, and FIG. 3 is a cross-sectional diagram cut along line 3-3 in FIG. 1. FIG. 1 illustrates an axial direction with an arrow A, a width direction with an arrow B, forward in the axial direction i with an arrow A1, and backward in the axial direction with an arrow A2. FIG. 1 illustrates a central axial line S1 with a dashed-dotted line.

The antenna 10A is comprised of a dielectric substrate 11 (print circuit board) having predetermined permittivity and an unbalanced power supply member 12 (a coaxial cable or a semi-rigid cable), a resonance conductor 13 and a grounding conductor 14, and a radiation conductor 15. The dielectric substrate 11 is formed with glass epoxy having predetermined permittivity. The dielectric substrate 11 can be also formed with a thermoplastic synthetic resin or a thermosetting synthetic resin having predetermined permittivity, or a ceramic substrate, other than glass epoxy The dielectric substrate 11 which has a plate shape having predetermined thickness, is molded so that the planar shape of the dielectric substrate 11 is a rectangle which is elongated in the axial direction. The dielectric substrate 11 has an upper face 16 (one face) and a lower face 17 (the other face), and has a first region 18 and a second region 19 sectioned by the central axial line S1 which divides a width direction of the dielectric substrate 11. The dielectric substrate 11 serves as a capacitor in which electric charge is accumulated at the antenna 10A. A length dimension in the axial direction, a length dimension in the width direction, and a thickness dimension between the upper face 16 and the lower face 17 of the dielectric substrate 11 are not particularly limited and are freely designed, so that a frequency bandwidth can be freely adjusted.

The unbalanced power supply member 12 is located on the central axial line S1 on the upper face 16 of the dielectric substrate 11, has predetermined length and extends in the axial direction. As illustrated in FIGS. 1 and 2, the unbalanced power supply member 12 is comprised of a rod-like elongated first conductor 20 (central metal conductor), an insulating body 21 which has a circular cross section and which covers an outer periphery of the first conductor 20, and a second conductor 22 (external metal conductor) which has a cylindrical cross section and which covers an outer periphery of the insulating body 21. At the unbalanced power supply member 12, an outer periphery of the first conductor 20 is fixedly attached to an inner periphery of the insulating body 21, and an outer periphery of the insulating body 21 is fixedly attached to an inner periphery of the second conductor 22. The unbalanced power supply member 12 has a non-power supply unit 23 which is set to have predetermined length (approximately $\lambda/4$) and which vertically extends in the axial direction, and a power supply unit 24 which extends forward in the axial direction from the non-power supply unit 23. A connector 25 is attached to a rear end of the unbalanced power supply member 12.

The non-power supply unit 23 is comprised of the first conductor 20, the insulating body 21 and the second conductor 22. The power supply unit 24 is comprised of the first conductor 20. A conductive metal such as gold, nickel, copper and silver can be used as the first conductor 20 and the second conductor 22, and thermoplastic synthetic resin (particularly, polytetrafluoroethylene having plastic permittivity) which becomes a material for fixing impedance of the unbalanced power supply member 12 can be used as the insulating body 21.

The resonance conductor 13 is formed with a conductive metal (such as gold, nickel, copper and silver) and is molded in a plate shape having a, predetermined area. The resonance conductor 13 is fixed on the upper face of the dielectric substrate 11. The resonance conductor 13 has a connection area 26 electrically connected to the unbalanced power supply member 12, a first resonance area 27 located in the first region 18 of the dielectric substrate 11, and a second resonance area 28 located in the second region 19 of the dielectric substrate 11.

The connection area 26 extends in a width direction across the central axial line S1. A periphery of the second conductor of the unbalanced power supply member 12 abuts on the connection area 26, and the second conductor 20 is electrically connected (fixed) to the connection area 26 through molding (such as soldering) (fixing means). The first resonance area 27 is coupled to the connection area 26, and extends in the axial direction while separating outward in the width direction from the central axial line S1 (first radiation area of a radiation conductor which will be described later) by a predetermined dimension. The second resonance area 28 is coupled to the connection area 26, and extends in the axial direction while separating outward in the width direction from the central axial line S1 (first radiation area of the radiation conductor) by a predetermined dimension. The connection area 26 and the first and the second resonance areas 27 and 28 are fixed on the upper face 16 of the dielectric substrate 11. The first resonance area 27 and the second resonance area 28 are shaped in a rectangle which has a predetermined width dimension and which is elongated in the axial direction, and have planar shapes of the same shape and the same size, which are symmetric with respect to the central axial line S1.

The first resonance area 27 has a first front end portion 29*a* extending in the width direction, and a first inner portion 30*a* and a first outer portion 31*a* extending in the axial direction, and the second resonance area 28 has a second front end portion 29*b* extending in the width direction, and a second inner portion 30*b* and a second outer portion 31*b* extending in the axial direction. In the first and the second resonance areas 27 and 28, the front end portions 29*a* and 29*b* have the same length dimension in the width direction, the inner portions 30*a* and 30*b* have the same length dimension in the axial direction, and the outer portions 31*a* and 31*b* have the same length direction in the axial direction. Further, the inner portions 30*a* and 30*b* have the same first separation dimension from the central axial line S1 (the first radiation area 37 of the radiation conductor 15), and the inner portions 30*a* and 30*b* are in parallel with respect to the central axial line S1 (the first radiation area 37).

The grounding conductor 14 which is formed with a conductive metal (such as gold, nickel, copper and silver), is molded in a plate shape having a predetermined area, and continuously coupled to the resonance conductor 13 (integrally formed with the resonance conductor 13). The grounding conductor 14 is fixed on the upper face 16 of the dielectric substrate 11. The grounding conductor 14 has a first ground area 32 located in the first region 18 of the dielectric substrate 11, and a second ground area 33 located in the second region 19 of the dielectric substrate 11.

The first ground area 32 is coupled to the first resonance area 27 and extends backward in the axial direction from the first resonance area 27 while separating outward in the width direction from the central axial line S1 (unbalanced power supply member 12) by a predetermined dimension. The second ground area 33 is coupled to the second resonance area 28 and extends backward in the axial direction from the second resonance area 28 while separating outward in the width direction from the central axial line S1 (unbalanced power supply member 12) by a predetermined dimension. The first ground area 32 and the second ground area 33 are fixed on the upper face 16 of the dielectric substrate 11. The first ground area 32 and the second ground area 33 are shaped in a rectangle which has a predetermined width dimension and which is elongated in the axial direction, and have planar shapes of the same shape and the same size, which are symmetric with respect to the central axial line S1.

The first ground area 32 has a first rear end portion 34*a* extending in the width direction, and a first inner portion 35*a* and a first outer portion 36*a* extending in the axial direction, and the second ground area 33 has a second rear end portion 34*b* extending in the width direction, and a second inner portion 35*b* and a second outer portion 36*b* extending in the axial direction. In the first and the second ground areas 32 and 33, the rear end portions 34*a* and 34*b* have the same length dimension in the width direction, the inner portions 35*a* and 35*b* have the same length dimension in the axial direction, and the outer portions 36*a* and 36*b* have the same length dimension in the axial direction. Further, the inner portions 35*a* and 35*b* have the same second separation dimension from the central axial line S1 (unbalanced power supply member 12), and the inner portions 35*a* and 35*b* are in parallel with respect to the central axial line S1 (unbalanced power supply member 12).

The radiation conductor 15 which is formed with a conductive metal (such as gold, nickel, copper and silver), is molded in a plate shape having a predetermined area, and fixed on the upper face 16 of the dielectric substrate 11. The radiation conductor 15 has a first radiation area 37 which is located between the first and the second resonance areas 27 and 28 and which extends forward in the axial direction from the connection area 26, and a second radiation area 38 which extends forward in the axial direction from a front end portion 39 of the first radiation area 37. The first and the second radiation areas 37 and 38 are integrally formed.

The first radiation area 37 is located between the first and the second resonance areas 27 and 28 of the resonance conductor 13. The first radiation area 37 has a rectangular shape which has a predetermined width dimension and which is elongated in the axial direction, and is fixed on the upper face 16 of the dielectric substrate 11. In the first radiation area 37, the area 37 located in the first region 18 of the dielectric substrate 11 and the area 37 located in the second region 19 of the dielectric substrate 11 are symmetric with respect to the central axial line S1. The rear end portion 40 of the first radiation area 37 is electrically connected to the power supply unit 24 of the unbalanced power supply member 12.

The second radiation area 38 separates forward in the axial direction from the first and the second front end portions 29*a* and 29*b* of the first and the second resonance areas 27 and 28 by a predetermined dimension and is fixed on the upper face 16 of the dielectric substrate 11. The second radiation area 38 has a larger width dimension than a width dimension of the first radiation area 37. In the second radiation area 38, the area 38 located in the first region 18 of the dielectric substrate 11 and the area 38 located in the second region 19 of the dielectric substrate 11 are symmetric with respect to the central axial line S1.

At the first rear end portion 41 of the second radiation area 38, facing the first front end portion 29*a* of the first resonance area 27, a plurality of radiation stepped portions 42 which dent stepwise forward in the axial direction toward outward of the width direction from the central axial line S1 (which distend stepwise backward in the axial direction toward the central axial line S1 from both side portions of the area 38) are formed. The radiation stepped portions 42 include a first radiation stepped portion 42*a* which is located at a side of the central axial line S1 and which dents forward in the axial direction from the first rear end portion 41, a second radiation stepped portion 42*b* which is located outward in a width direction of the first radiation stepped portion 42*a* and which dents forward in the axial direction from the first radiation stepped portion 42*a*, and a third radiation stepped portion 42*c* which is located outward in a width direction of the second radiation stepped portion 42*b* and which tilts so as to gradually separate from the central axial line S1. It should be noted that the number of radiation stepped portions 42 is not limited to three, and four or more stepped radiation portions 42 may be formed.

At the second rear end portion 43 of the second radiation area 38, facing the second front end portion 29*b* of the second resonance area 28, a plurality of radiation stepped portions 44 which dent stepwise forward in the axial direction toward outward in the width direction from the central axial line S1 (which distend stepwise backward in the axial direction toward the central axial line S1 from both side portions of the area 38) are formed. The radiation stepped portions 44 include a first radiation stepped portion 44*a* which is located at a side of the central axial line S1 and which dents forward in the axial direction from the second rear end portion 43, a second radiation stepped portion 44*b* which is located outward in a width direction of the first radiation stepped portion 44*a* and which dents forward in the axial direction from the first radiation stepped portion 44*a*, and a third radiation stepped portion 44*c* which is located outward in a width direction of the second radiation stepped portion 44*b* and which tilts so as to gradually separate from the central axial line S1. It should be noted that the number of the radiation stepped portions 44 is not limited to three, and four or more radiation stepped portions 44 may be formed.

A separation dimension in the axial direction between the first and the second front end portions 29*a* and 29*b* of the first and the second resonance areas 27 and 28 and the first radiation stepped portions 42*a* and 44*a* is greater than a separation dimension in the axial direction between the first and the second front end portions 29*a* and 29*b* of the first and the second resonance areas 27 and 28 and the first and the second rear end portions 41 and 43 of the second radiation area 38, and a separation dimension in the axial direction between the first and the second front end portions 29*a* and 29*b* and the second radiation stepped portions 42*b* and 44*b* is greater than a separation dimension in the axial direction between the first and the second front end portions 29*a* and 29*b* and the first radiation stepped portions 42*a* and 44*a*. A separation dimension in the axial direction between the first and the second front end portions 29*a* and 29*b* and the third radiation stepped portions 42*c* and 44*c* is greater than a separation dimension in the axial direction between the first and the second front end portions 29*a* and 29*b* and the second radiation stepped portions 42*b* and 44*b*.

At the antenna 10A, the dielectric substrate 11 having predetermined permittivity serves as a dielectric body, a high frequency current of substantially the same direction flows between the first to the third radiation stepped portions 42*a* to 42*c* of the first rear end portion 41 of the second radiation area 38 and the first front end portion 29*a* of the first resonance area 27, and the first to the third radiation stepped portions 42*a* to 42*c* and the first front end portion 29*a* resonate at a plurality of points via the high frequency current of substantially the same direction, while a high frequency current of substantially the same direction flows between the first to the third radiation stepped portions 44*a* to 44*c* of the second rear end portion 43 of the second radiation area 38 and the second front end portion 29*b* of the second resonance area 28, and the first to the third radiation stepped portions 44*a* to 44*c* and the second front end portion 29*b* resonate at a plurality of points via the high frequency current of substantially the same direction.

Further, at the antenna 10A, a high frequency current induced at the first and the second front end portions 29*a* and 29*b* of the first and the second resonance areas 27 and 28 and a high frequency current induced at the first and the second rear end portions 41 and 43 of the second radiation area 38 resonate, while a high frequency current induced at the second resonance areas 27 and 28 (first and the second inner portions 30*a* and 30*b*) and a high frequency current induced at the first radiation area 37 resonate.

Because the second radiation area 38 and the first and the second resonance areas 27 and 28 resonate at a plurality of points, while the first and the second resonance areas 27 and 28 and the first radiation area 37 resonate, the antenna 10A can obtain a plurality of resonance frequencies of different bands. Because the antenna 10A can obtain a plurality of resonance frequencies of different bands, and the obtained plurality of resonance frequencies are continuously adjacent to each other and partly overlap with each other, it is possible to drastically expand a use frequency band at the antenna 10A. The antenna 10A can achieve a VSWR of 2 or less, and can transmit or receive a radio wave in a full band among frequency bands (fractional bandwidths) which can be used, and the antenna can be used in a wide band, and can transmit or receive a radio wave of a wide band only with one antenna.

At the antenna 10A, a separation dimension between the first and the second inner portions 30*a* and 30*b* of the first and the second resonance areas 27 and 28, and the central axial line S1 falls within a range between 0.5 and 1.0 mm, while a separation dimension between the first and the second inner portions 35*a* and 35*b* of the first and the second ground areas 32 and 33, and the central axial line S1 falls within a range between 1.9 and mm. If these separation dimensions exceed the above-described ranges, saturation occurs in a state where the antenna 10A can use the widest frequency band, and the frequency band of the antenna 10A cannot be expanded wider. By changing these separation dimensions within the above-described ranges, it is possible to adjust a use frequency band to be wider or narrower, so that it is possible to stabilize a resonance band.

The antenna 10A can achieve optimal resonance efficiency of a radio wave by these separation dimensions being set to fall within the above-described ranges, so that it is possible to make the second radiation area 38 and the first and the second resonance areas 27 and 28 resonate efficiently at a plurality of points, while it is possible to make the first and the second resonance areas 27 and 28 and the first radiation area 37 resonate efficiently.

At the antenna 10A, a length dimension in the axial direction of the grounding conductor 14 falls within a range of 10 and 15 cm, and the length dimension is set to be length of approximately ¼ wavelength (approximately λ/4) of 700 MHz. By setting the length dimension to fall within the above-described range, the length dimension becomes length of approximately ¼ wavelength of 700 MHz, so that it is possible to lower a lower limit frequency to 700 MHz while the size of the antenna 10A is kept small.

Figure 4:
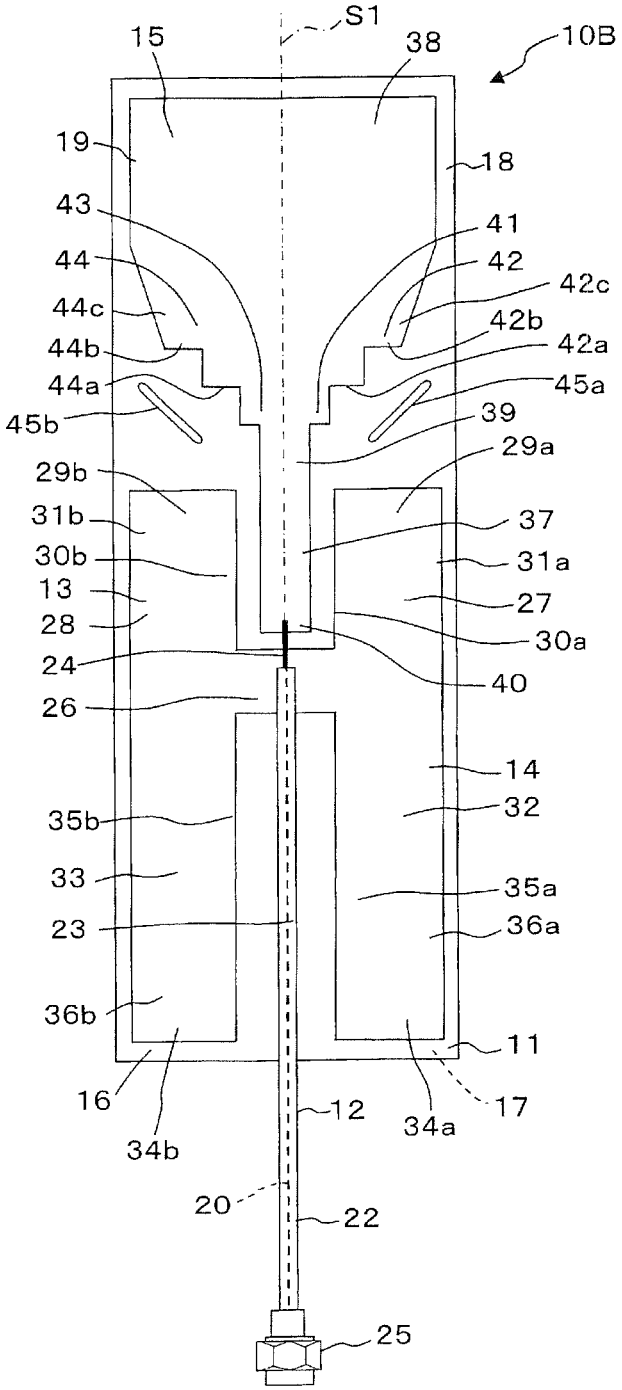
FIG. 4 is a plan view of an antenna illustrated as another example.
Figure 5:
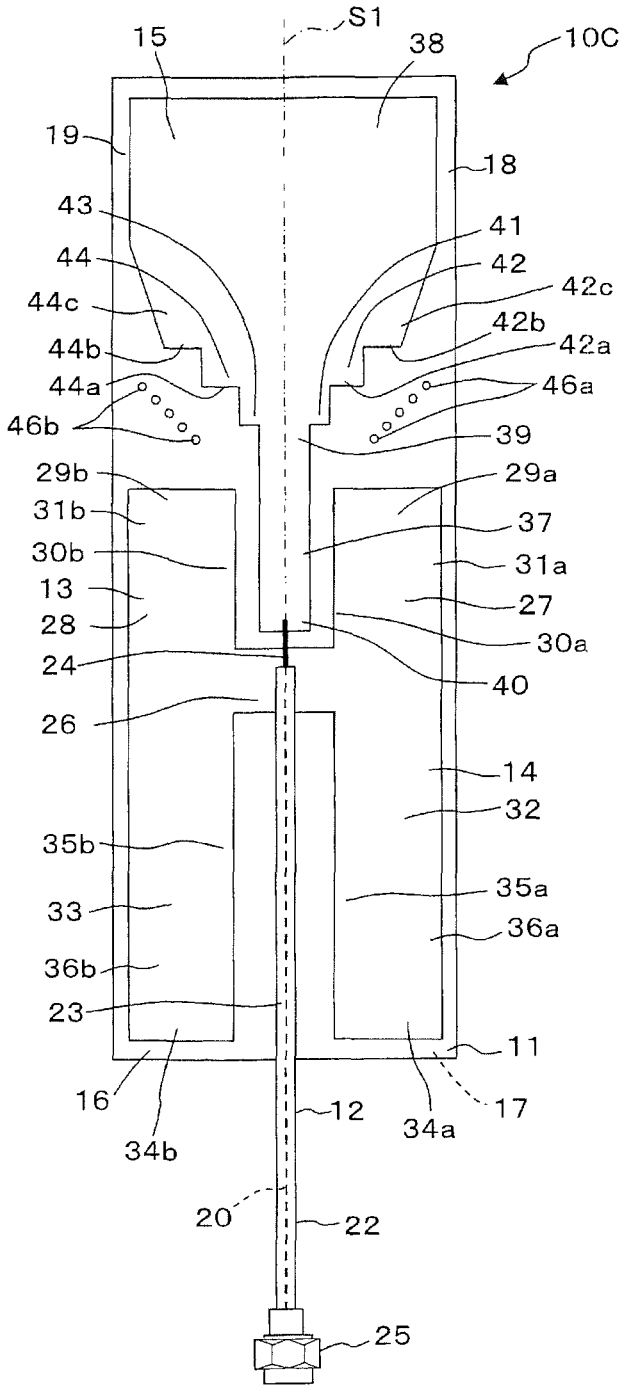
FIG. 5 is a plan view of an antenna illustrated as another example.

FIG. 4 is a plan view of an antenna 10B illustrated as another example, and FIG. 5 is a plan view of an antenna 10C illustrated as another example. The antenna 10B in FIG. 4 is different from the antenna 10A in FIG. 1 in that first and second slits 45*a* and 45*b* which penetrate the dielectric substrate 11 (print circuit board) are formed at the dielectric substrate 11, and the antenna 10C in FIG. 5 is different from the antenna 10A in FIG. 1 in that a plurality of first and second through holes 46*a* and 46*b* which penetrate the dielectric substrate 11 (print circuit board) are formed at the dielectric substrate 11. Because other components of the antennas 10B and 10C are the same as those of the antenna 10A in FIG. 1, the same reference numerals as those of antenna 10A in FIG. 1 are assigned, and explanation of other components of the antennas 10B and 10C will be omitted by using explanation of the antenna 10A.

As with the antenna 10A in FIG. 1, each of the antennas 10B and 10C is comprised of the dielectric substrate 11 and the unbalanced power supply member 12, the resonance conductor 13 and the grounding conductor 14, and the radiation conductor 15. The dielectric substrate 11, the unbalanced power supply member 12, the resonance conductor 13, the grounding conductor 14 and the radiation conductor 15 are the same as those of the antenna 10A in FIG. 1. Further, a separation dimension between the first and the second inner portions 30*a* and 30*b* of the first and the second resonance areas 27 and 28 and the central axial line S1, and a separation dimension between the first and the second inner portions 35*a* and 35*b* of the first and the second ground areas 32 and 33 and the central axial line S1 are the same as those of the antenna 10A in FIG. 1. A total dimension of a length dimension in the axial direction of the resonance conductor 13 and a length dimension in the axial direction of the grounding conductor 14 are the same as that of the antenna 10A in FIG. 1.

At the dielectric substrate 11 which extends between the first front end portion 29*a* of the first resonance area 27 and the first rear end portion 41 of the second radiation area 38 of the antenna 10B, a first slit 45*a* which penetrates the substrate 11 is formed. At the dielectric substrate 11 which extends between the second front end portion 29*b* of the second resonance area 28 and the second rear end portion 43 of the second radiation area 38 of the antenna 10B, a second slit 45*b* which penetrates the substrate 11 is formed.

The first slit 45*a* which is located near the radiation stepped portions 42 (the first to the third radiation stepped portions 42*a* to 42*c*), extends while tilting so as to gradually separate from the central axial line S1 toward forward in the axial direction from the first rear end portion 41. In other words, the first slit 45*a* extends along the first to the third radiation stepped portions 42*a* to 42*c*. The second slit 45*b* which is located near the radiation stepped portions 44 (the first to the third radiation stepped portions 44*a* to 44*c*), extends while tilting so as to gradually separate from the central axial line S1 toward forward in the axial direction from the second rear end portion 43. In other words, the second slit 45*b* extends along the first to the third radiation stepped portions 44*a* to 44*c*.

At the dielectric substrate 11 which extends between the first front end portion 29*a* of the first resonance area 27 and the first rear end portion 41 of the second radiation area 38 of the antenna 10C, a plurality of first through holes 46*a* which penetrate the substrate 11 are formed. At the dielectric substrate 11 which extends between the second front end portion 29*b* of the second resonance area 28 and the second rear end portion 43 of the second radiation area 38 of the antenna 10C, a plurality of second through holes 46*b* which penetrate the substrate 11 are formed.

The first through holes 46*a* which are located near the radiation stepped portions 42 (the first to the third radiation stepped portions 42*a* to 42*c*), are aligned while tilting so as to gradually separated from the central axial line S1 toward forward in the axial direction from the first rear end portion 41. In other words, the first through holes 46*a* are aligned along the first to the third radiation stepped portions 42*a* to 42*c*. The second through holes 46*b* which are located near the radiation stepped portions 44 (the first to the third radiation stepped portions 44*a* to 44*c*), are aligned while tilting so as to gradually separate from the central axial line S1 toward forward in the axial direction from the second rear end portion 43. In other words, the second through holes 46*b* are aligned along the first to the third radiation stepped portions 44*a* to 44*c*.

These antennas 10B and 10C have the following advantageous effects in addition to the advantageous effects of the antenna 10A in FIG. 1. In the antennas 10B and 10C, because the first and the second slits 45*a* and 45*b* or the first and the second through holes 46*a* and 46*b* which are located near the first to the third radiation stepped portions 42*a* to 42*c* and 44*a* to 44*c*, are formed on the dielectric substrate 11, coupling capacitance of the substrate 11 which extends between the first and the second front end portions 29*a* and 29*b* of the first and the second resonance areas 27 and 28 and the first and the second rear end portions 41 and 43 of the second radiation area 38 can be reduced, so that it is possible to drastically improve tan δ as an element of radio wave conversion efficiency at the antennas 10B and 10C. As a result of the slits 45*a* and 45*b* or the through holes 46*a* and 46*b* being formed at the dielectric substrate 11 near the radiation stepped portions 42*a* to 42*c* and 44*a* to 44*c*, the antennas 10B and 10C can increase radiation gains and can emit radio waves farther.

Figure 6:
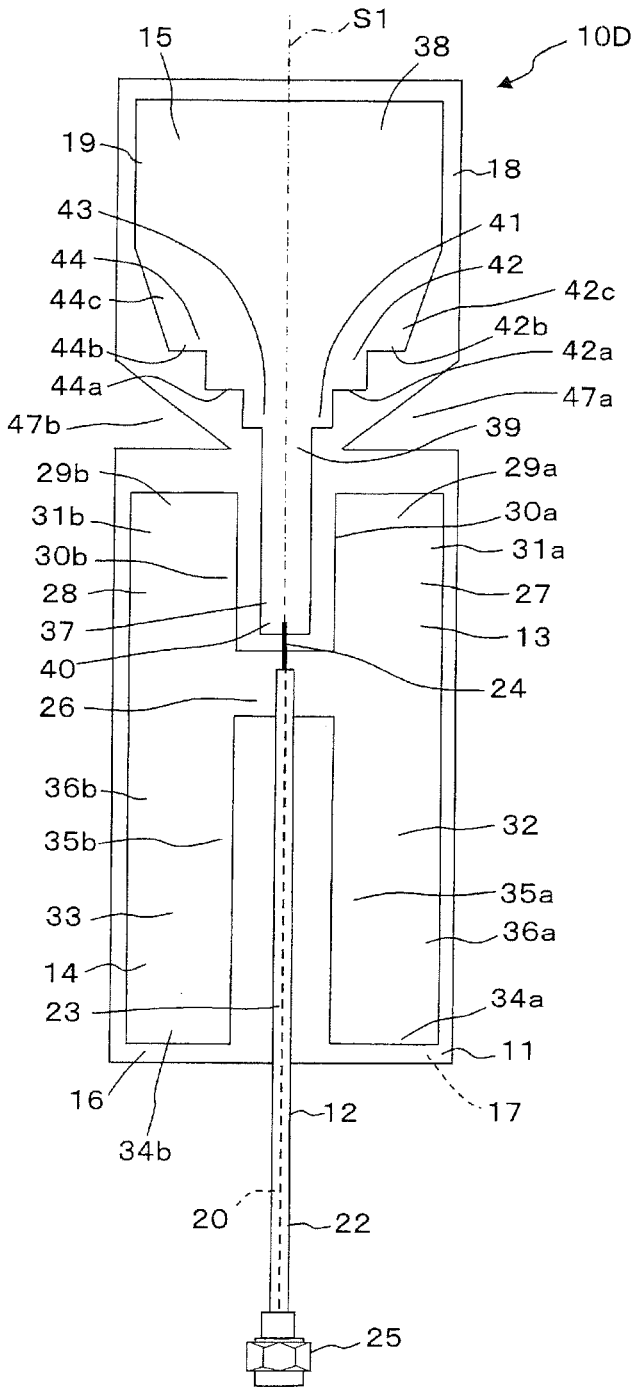
FIG. 6 is a plan view of an antenna illustrated as another example.

FIG. 6 is a plan view of an antenna 10*d* illustrated as another example. The antenna 10D in FIG. 6 is different from the antennas in FIGS. 1, 4 and 5 in that first and second void portions 47*a* and 47*b* are formed, and because other components of the antenna 10D are the same as those of the antennas 10A to 100 in FIGS. 1, 4 and 5, the same reference numerals as those of the antennas 10A to 100 in FIGS. 1, 4 and 5 are assigned, and explanation of other components of the antenna 10D will be omitted by using explanation of the antennas 10A to 100.

A void portion 47*a* where the dielectric substrate 11 does not exist is formed between the first front end portion 29*a* of the first resonance area 27 and the first rear end portion 41 of the second radiation area 38. A void portion 47*b* where the dielectric substrate 11 does not exist is formed between the second front end portion 29*b* of the second resonance area 28 and the second rear end portion 43 of the second radiation area 38. While these void portions 47*a* and 47*b* have a triangular shape in which a dimension in the axial direction gradually increases toward outward in the width direction from the central axial line S1, the shape of the void portions 47*a* and 47*b* is not limited to a triangle, and may be any shape if a portion where the dielectric substrate 11 does not exist is formed between the first front end portion 29*a* and the first rear end portion 41, and between the second front end portion 29*b* and the second rear end portion 43.

The antenna 10D has the following advantageous effects in addition to the advantageous effects of the antenna 10A in FIG. 1. In the antenna 10D, because the first and the second void portions 47*a* and 47*b* where the dielectric substrate 11 does not exist are formed between the first front end portion 29*a* of the first resonance area 27 and the first rear end portion 41 of the second radiation area 38 and between the second front end portion 29*b* of the second resonance area 28 and the second rear end portion 43 of the second radiation area 38, coupling capacitance between the first and the second front end portions 29*a* and 29*b* of the first and the second resonance areas 27 and 28 and the first and the second rear end portions 41 and 43 of the second radiation area 38 can be drastically reduced, so that it is possible to reduce a rate at which heat is dissipated instead of a radio wave being generated, and it is possible to drastically improve tan δ as an element of radio wave conversion efficiency at the antenna 10D. As a result of the void portions 47*a* and 47*b* being formed, the antenna 10D can increase a radiation gain and can emit a radio wave farther.

Figure 7:
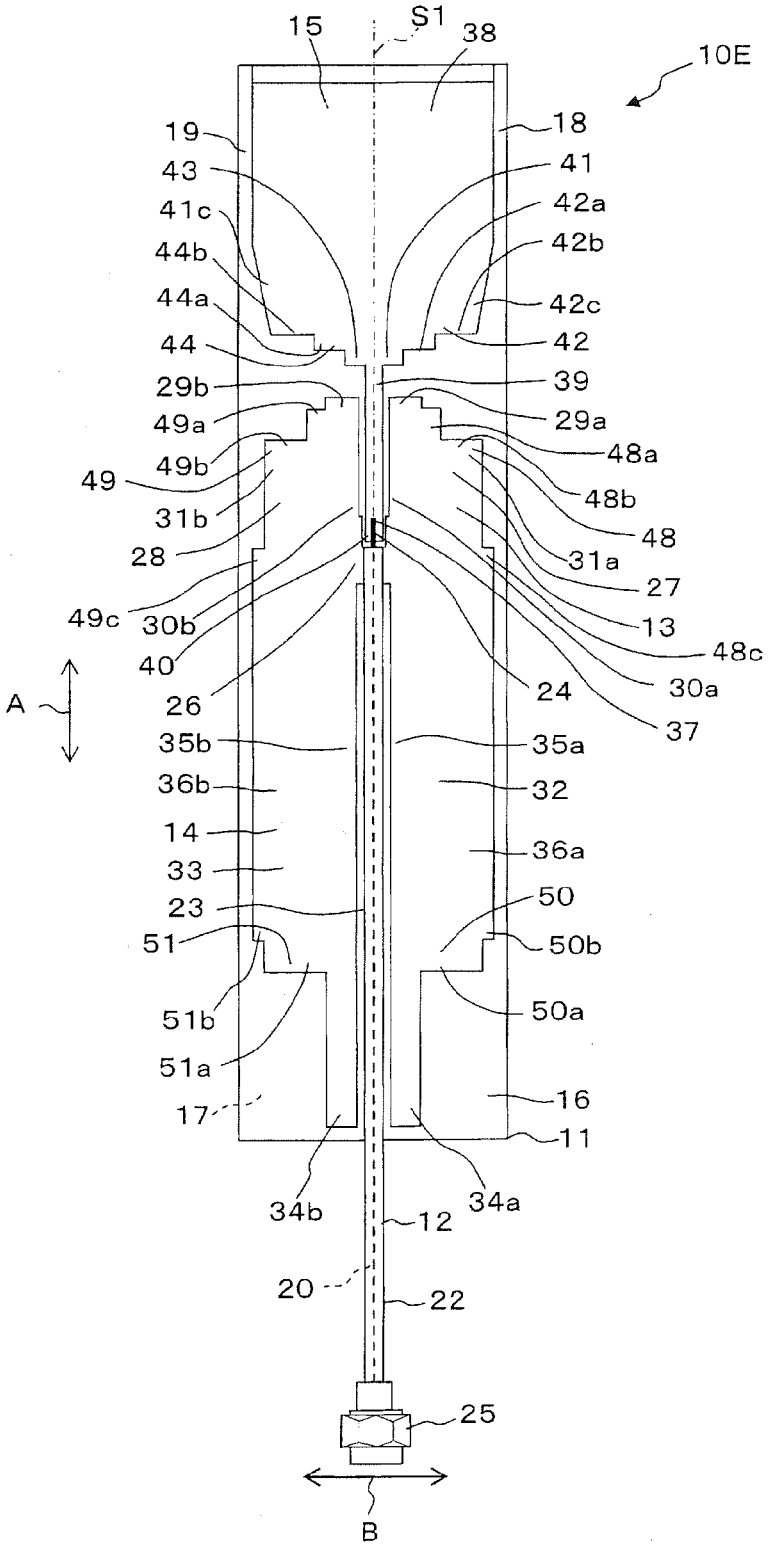
FIG. 7 is a plan view of an antenna illustrated as another example.

FIG. 7 is a plan view of an antenna 10E illustrated as another example. FIG. 7 illustrates the axial direction with an arrow A, the width direction with an arrow B, and the central axial line S1 with a dashed-dotted line. The antenna 10E in FIG. 7 is different from the antenna 10A in FIG. 1 in that a plurality of resonance stepped portions 48 are formed at the first front end portion 29*a* of the first resonance area 27, a plurality of resonance stepped portions 49 are formed at the second front end portion 29*b* of the second resonance area 28, a plurality of attenuating stepped portions 50 are formed at the first rear end portion 34*a* of the first ground area 32, and a plurality of attenuating stepped portions 51 are formed at the second rear end portion 34*b* of the second ground area 33. Because other components of the antenna 10E are the same as those of the antenna 10A in FIG. 1, the same reference numerals as those of the antenna 10A in FIG. 1 are assigned, and explanation of other components of the antenna 10E will be omitted by using explanation of the antenna 10A.

As with the antenna 10A in FIG. 1, the antenna 10E is comprised of the dielectric substrate 11 and the unbalanced power supply member 12, the resonance conductor 13 and the grounding conductor 14, and the radiation conductor 15. The dielectric substrate 11, the unbalanced power supply member 12, the resonance conductor 13, the grounding conductor 14 and the radiation conductor 15 are the same as those of the antenna 10A in FIG. 1. Further, a separation dimension between the first and the second inner portions 30*a* and 30*b* of the first and the second resonance areas 27 and 28 and the central axial line S1, and a separation dimension between the first and the second inner portions 35*a* and 35*b* of the first and the second ground areas 32 and 33 are the same as those of the antenna 10A in FIG. 1. A total dimension of a length dimension in the axial direction of the resonance conductor 13 and a length dimension in the axial direction of the grounding conductor 14 is the same as that of the antenna 10A in FIG. 1.

At the first front end portion 29*a* of the first resonance area 27, a plurality of resonance stepped portions 48 which dent stepwise backward in the axial direction toward outward in the width direction from the central axial line S1 (which distend stepwise forward in the axial direction toward the central axial line S1 from the first outer portion 31*a* of the area 27) are formed. The resonance stepped portions 48 include a first resonance stepped portion 48*a* which is located at a side of the central axial line S1 and which dents backward in the axial direction from the first front end portion 29*a* of the first resonance area 27, a second resonance stepped portion 48*b* which is located outward in a width direction of the first resonance stepped portion 48*a* and which dents backward in the axial direction from the first resonance stepped portion 48*a*, and a third resonance stepped portion 48*c* which is located outward in a width direction of the second resonance stepped portion 48*b* and which dents backward in the axial direction from the second resonance stepped portion 48*b*. It should be noted that the number of resonance stepped portions 48 is not limited to three, and four or more resonance stepped portions 48 may be formed.

At the second front end portion 29*b* of the second resonance area 28, a plurality of resonance stepped portions 49 which dent stepwise backward in the axial direction toward outward in the width direction from the central axial line S1 (which distend stepwise forward in the axial direction toward the central axial line S1 from the second outer portion 31*b* of the area 28) are formed. The resonance stepped portions 49 include a first resonance stepped portion 49*a* which is located at a side of the central axial line S1 and which dents backward in the axial direction from the second front end portion 29*b* of the second resonance area 28, a second resonance stepped portion 49*b* which is located outward in a width direction of the first resonance stepped portion 49*a* and which dents backward in the axial direction from the first resonance stepped portion 49*a*, and a third resonance stepped portion 49*c* which is located outward in a width direction of the second resonance stepped portion 49*b* and which dents backward in the axial direction from the second resonance stepped portion 49*b*. It should be noted that the number of the resonance stepped portions 49 is not limited to three, and four or more resonance stepped portions 49 may be formed.

A separation dimension in the axial direction between the first resonance stepped portions 48*a* and 49*a* of the first and the second resonance areas 27 and 18 and the first radiation stepped portions 42*a* and 44*a* of the second radiation area 38 is greater than a separation dimension in the axial direction between the first and the second front end portions 29*a* and 29*b* of the first and the second resonance areas 27 and 28 and the first and the second rear end portions 41 and 43 of the second radiation area 38, while a separation dimension in the axial direction between the second resonance stepped portions 48*b* and 49*b* and the second radiation stepped portions 42*b* and 44*b* is greater than a separation dimension in the axial direction between the first resonance stepped portions 48*a* and 49*a* and the first radiation stepped portions 42*a* and 44*a*. A separation dimension in the axial direction between the third resonance stepped portions 48*c* and 49*c* and the third radiation stepped portions 42*c* and 44*c* is greater than a separation dimension in the axial direction between the second resonance stepped portions 48*b* and 49*b* and the second radiation stepped portions 42*b* and 44*b*.

At the first rear end portion 34*a* of the first ground area, a plurality of attenuating stepped portions 50 which dent stepwise forward in the axial direction toward outward in the width direction from the central axial line S1 (which distend stepwise backward in the axial direction toward the central axial line S1 from the first outer portion 36*a* of the area 32) are formed. The attenuating stepped portions 50 include a first attenuating stepped portion 50*a* which is located at a side of the central axial line S1 and which dents forward in the axial direction from the first rear end portion 34*a* of the first ground area 32, and a second attenuating stepped portion 50*b* which is located outward in a width direction of the first attenuating stepped portion 50*a* and which dents forward in the axial direction from the first attenuating stepped portion 50*a*. It should be noted that the number of the attenuating stepped portions 50 is not limited to two, and three or more attenuating stepped portions 50 may be formed.

At the second rear end portion 34*b* of the second ground area 33, a plurality of attenuating stepped portions 51 which dent stepwise forward in the axial direction toward outward in the width direction from the central axial line S1 (which distend stepwise backward in the axial direction toward the central axial line S1 from the second outer portion 36*b* of the area 33) are formed. The attenuating stepped portions 51 include a first attenuating stepped portion 51*a* which is located at a side of the central axial line S1 and which dents forward in the axial direction from the second rear end portion 34*b* of the second ground area 33, and a second attenuating stepped portion 51*b* which is located outward in a width direction of the first attenuating stepped portion 51*a* and which dents forward in the axial direction from the first attenuating stepped portion 51*a*. It should be noted that the number of attenuating stepped portions 51 is not limited to two, and three or more attenuating stepped portions 51 may be formed.

At the antenna 10E, a high frequency current of substantially the same direction flows between the first to the third radiation stepped portions 42*a* to 42*c* of the first rear end portion 41 of the second radiation area 38 and the first to the third resonance stepped portions 48*a* to 48*c* of the first front end portion 29*a* of the first resonance area 27, and the first to the third radiation stepped portions 42*a* to 42*c* and the first to the third resonance stepped portions 48*a* to 48*c* resonate at a plurality of points via the high frequency current of substantially the same direction, while a high frequency current of substantially the same direction flows between the first to the third radiation stepped portions 44*a* to 44*c* of the second rear end portion 43 of the second radiation area 38 and the first to the third resonance stepped portions 49*a* to 49*c* of the second front end portion 29*b* of the second resonance area 28, and the first to the third radiation stepped portions 44*a* to 44*c* and the first to the third resonance stepped portions 49*a* to 49*c* resonate at a plurality of points via the high frequency current of substantially the same direction.

Further, at the antenna 10E, a high frequency current induced at the first and the second front end portions 29*a* and 29*b* of the first and the second resonance areas 27 and 28 and a high frequency current induced at the first and the second rear end portions 41 and 43 of the second radiation area 38 resonate, while a high frequency current induced at the first and the second resonance areas 27 and 28 (the first and the second inner portions 30*a* and 30*b*) and a high frequency current induced at the first radiation area 37 resonate. At the antenna 10E, a radio is attenuated or blocked by the first and the second attenuating stepped portions 50*a*, 50*b*, 51*a* and 51*b* formed at the first and the second rear end portions 34*a* and 34*b* of the first and the second ground areas 32 and 33.

Because the second radiation area 38 and the first and the second resonance areas 27 and 28 resonate at a plurality of points, while the first and the second resonance areas 27 and 28 and the first radiation area 37 resonate, the antenna 10E can obtain a plurality of resonance frequencies of different bands. At the antenna 10E, because a plurality of resonance frequencies of different bands can be obtained, and the obtained plurality of resonance frequencies are continuously adjacent to each other and partly overlap with each other, it is possible to drastically expand a use frequency band at the antenna 10E. The antenna 10E can achieve a VSWR of 2 or less, and can transmit or receive a radio wave in a full band among frequency bands (fractional bandwidths) which can be used, and the antenna 10E can be used in a wide band and can transmit or receive a radio wave of a wide band only with one antenna.

At the antenna 10E, when a high frequency current flows at the first and the second rear end portions 34*a* and 34*b* of the first and the second ground areas 32 and 33, although the high frequency current flows through a chassis and a connection cable of a transceiver connected to the antenna 10E, which affects and changes a radiation pattern of a radio wave and a gain at the antenna 10E, because it is possible to attenuate or block the radio wave by the first and the second attenuating stepped portions 50*a*, 50*b*, 51*a* and 51*b* formed at the first and the second rear end portions 34*a* and 34*b* of the first and the second ground areas 32 and 33, the high frequency current does not flow through the chassis and the connection cable of the transceiver, so that it is possible to prevent change of the radiation pattern of the radio wave and the gain at the antenna 10E and secure a radiation pattern and a gain at the antenna 10E as designed.

At the antenna 10E, by setting a separation dimension between the first and the second inner portions 30*a* and 30*b* of the first and the second resonance areas 27 and 28 and the central axial line S1 to fall within a range between 0.5 and 1.0 mm, and by setting a separation dimension between the first and the second inner portions 35*a* and 35*b* of the first and the second ground areas 32 and 33 and the central axial line S1 to fall within a range between 1.9 and 10 mm, resonance efficiency of a radio wave becomes optimal, so that it is possible to make the second radiation area 38 and the first and the second resonance areas 27 and 28 efficiently resonate at a plurality of points, make the first and the second resonance areas 27 and 28 and the first radiation area 37 efficiently resonate, and make the non-power supply unit 22 and the first and the second ground areas 32 and 33 efficiently resonate.

At the antenna 10E, a length dimension in the axial direction of the grounding conductor 14 falls within a range between 10 and 15 cm, and the length dimension is set at length of approximately ¼ (approximately λ/4) of 700 MHz. By setting the length dimension within the above-described range, because the length dimension becomes length of approximately ¼ wavelength of 700 MHz, it is possible to lower a lower limit frequency to 700 MHz while the size of the antenna 10E is kept small.

Figure 8:
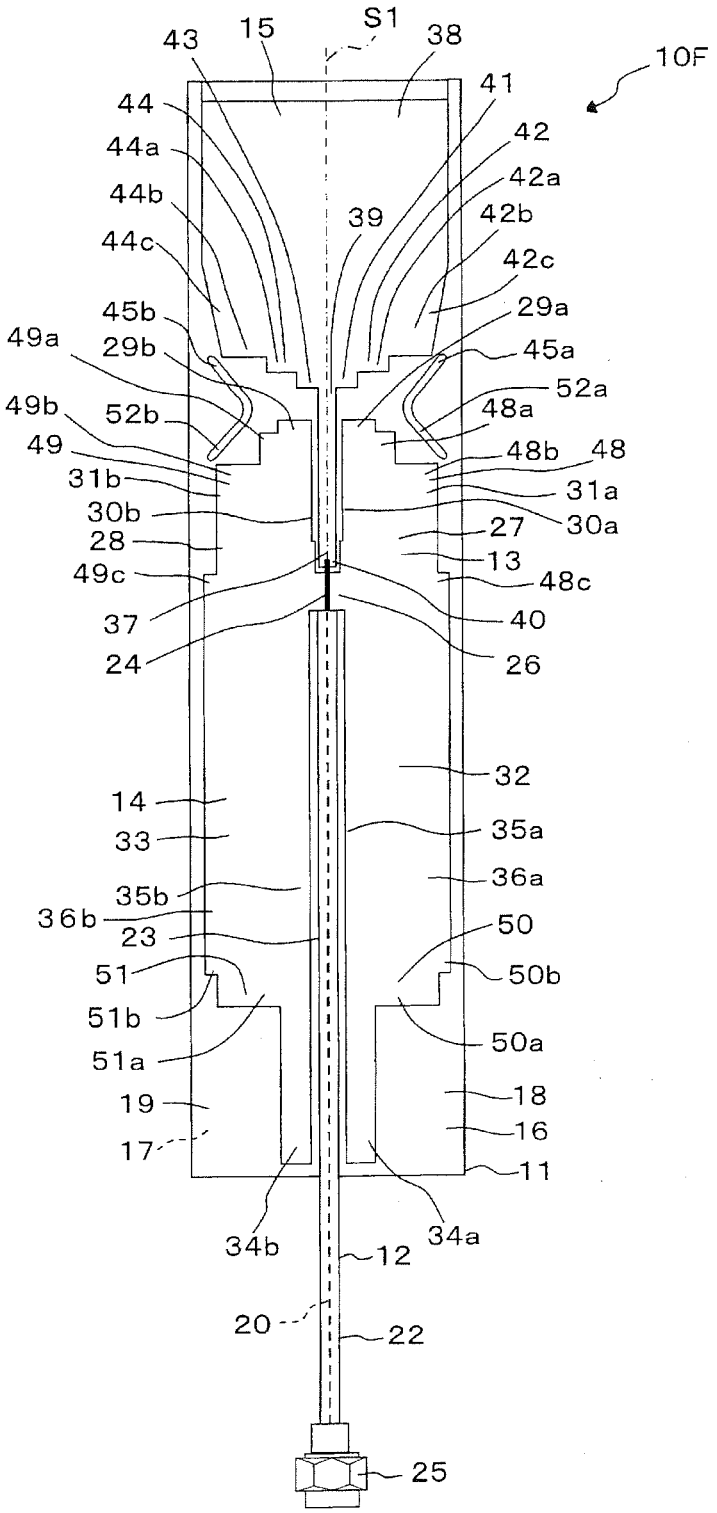
FIG. 8 is a plan view of an antenna illustrated as another example.
Figure 9:
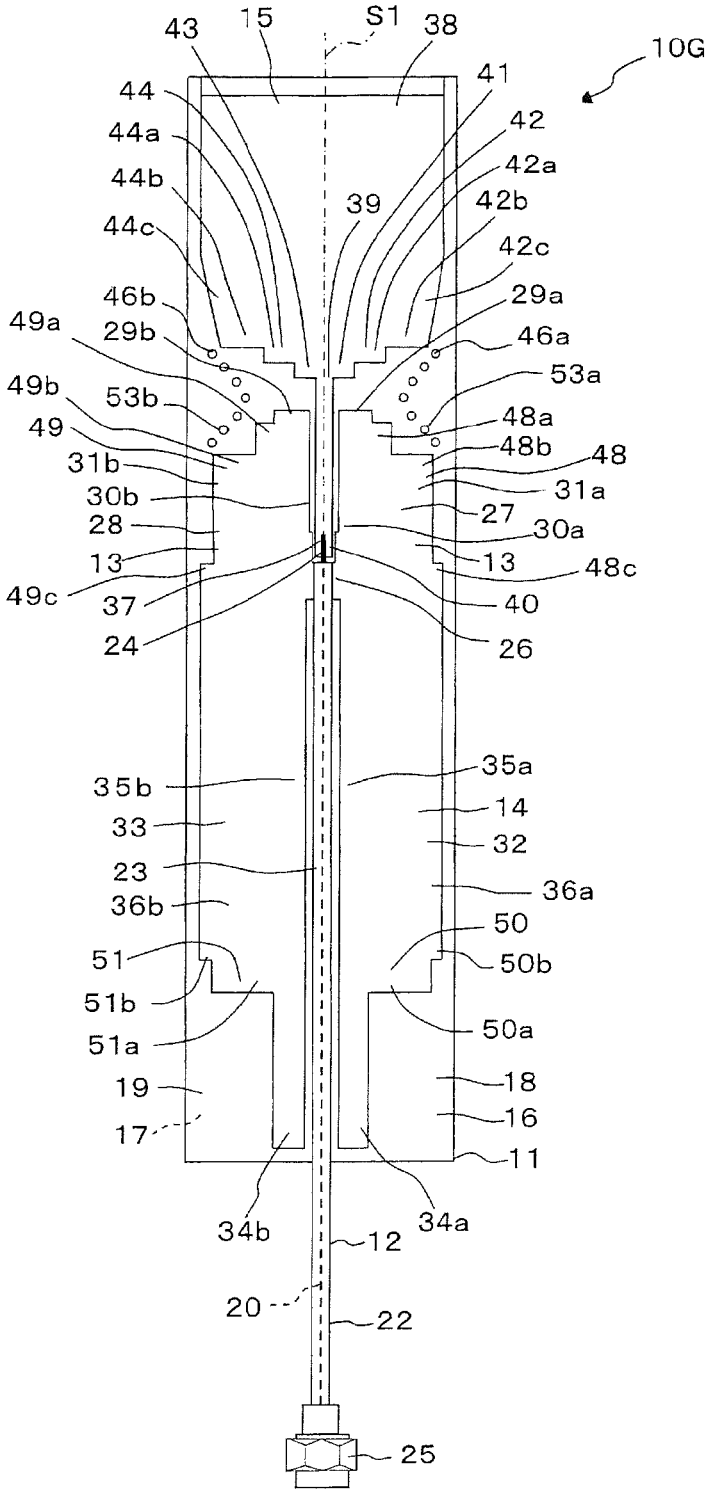
FIG. 9 is a plan view of an antenna illustrated as another example.

FIG. 8 is a plan view of an antenna 10F illustrated as another example, and FIG. 9 is a plan view of an antenna 10G illustrated as another example. The antenna 10F in FIG. 8 is different from the antennas in FIGS. 1 and 7 in that first to fourth slits 45*a*, 45*b*, 52*a* and 52*b* which penetrate the dielectric substrate 11 (print circuit board) are formed at the dielectric substrate 11, while the antenna 10G in FIG. 9 is different from the antennas in FIGS. 1 and 7 in that a plurality of first to fourth through holes 46*a*, 46*b*, 53*a* and 53*b* which penetrate the dielectric substrate 11 (print circuit board) are formed at the dielectric substrate 11. Because other components of the antennas 10F and 10G are the same as those of the antennas 10A and 10E in FIGS. 1 and 7, the same reference numerals as those of the antennas 10A and 10D are assigned, and explanation of other components of the antennas 10F and 10G will be omitted by using explanation of the antennas 10A and 10D.

At the dielectric substrate 11 which extends between the first front end portion 29*a* of the first resonance area 27 and the first rear end portion 41 of the second radiation area 38 of the antenna 10F, a first slit 45*a* and a third slit 52*a* which penetrate the substrate 11 are formed. At the dielectric substrate 11 which extends between the second front end portion 29*b* of the second resonance area 28 and the second rear end portion 43 of the second radiation area 38 of the antenna 10F, a second slit 45*b* and a fourth slit 52*b* which penetrate the substrate 11 are formed.

The first slit 45*a* which is located near the radiation stepped portions 42 (the first to the third radiation stepped portions 42*a* to 42*c*), extends while tilting so as to gradually separate from the central axial line S1 toward forward in the axial direction from the first rear end portion 41. The second slit 45*b* which is located near the radiation stepped portions 44 (the first to the third radiation stepped portions 44*a* to 44*c*), extends while tilting so as to gradually separate from the central axial line S1 toward forward in the axial direction from the second rear end portion 43.

The third slit 52*a* which is located near the resonance stepped portions 48 (the first to the third resonance stepped portions 48*a* to 48*c*), extends while tilting so as to gradually separate from the central axial line S1 toward backward in the axial direction from the first front end portion 29*a*. In other words, the third slit 52*a* extends along the first to the third resonance stepped portions 48*a* to 48*c*. The fourth slit 52*b* which is located near the resonance stepped portions 49 (the first to the third resonance stepped portions 49*a* to 49*c*), extends while tilting so as to gradually separate from the central axial line S1 toward backward in the axial direction from the second front end portion 29*b*. In other words, the fourth slit 52*b* extends along the first to the third resonance stepped portions 49*a* to 49*c*.

At the dielectric substrate 11 which extends between the first front end portion 29*a* of the first resonance area 27 and the first rear end portion 41 of the second radiation area 38 of the antenna 10G, a plurality of first through holes 46*a* and third through holes 53*a* which penetrate the substrate 11 are formed. At the dielectric substrate 11 which extends between the second front end portion 29*b* of the second resonance area 28 and the second rear end portion 43 of the second radiation area 38 of the antenna 10G, a plurality of second through holes 46*b* and fourth through holes 53*b* which penetrate the substrate 11 are formed.

The first through holes 36*a* which are located near the radiation stepped portions 42 (the first to the third radiation stepped portions 42*a* to 42*c*), are aligned while tilting so as to gradually separate from the central axial line S1 toward forward in the axial direction from the first rear end portion 41. The second through holes 46*b* which are located near the radiation stepped portions 44 (the first to the third radiation stepped portions 44*a* to 44*c*), are aligned while tilting so as to gradually separate from the central axial line S1 toward forward in the axial direction from the second rear end portion 43.

The third through holes 53*a* which are located near the resonance stepped portions 48 (the first to the third resonance stepped portions 48*a* to 48*c*), are aligned while tilting so as to gradually separate from the central axial line S1 toward backward in the axial direction from the first front end portion 29*a*. In other words, the third through holes 53*a* are aligned along the first to the third resonance stepped portions 48*a* to 48*c*. The fourth through holes 53*b* which are located near the resonance stepped portions 49 (the first to the third resonance stepped portions 49*a* to 49*c*), are aligned while tilting so as to gradually separate from the central axial line S1 toward backward in the axial direction from the second front end portion 29*b*. In other words, the fourth through holes 53*b* are aligned along the first to the third resonance stepped portions 49*a* to 49*c*.

The antennas 10F and 10G have the following advantageous effects in addition to the advantageous effects of the antennas 10A and 10E in FIGS. 1 and 7. At the antennas 10F and 10G, because the first and the second slits 45*a* and 45*b* or the first and the second through holes 46*a* and 46*b* which are located near the first to the third radiation stepped portions 42*a* to 42*c* and 44*a* to 44*c* are formed at the dielectric substrate 11, and the third and the fourth slits 52*a* and 52*b* or the third and the fourth through holes 53*a* and 53*b* which are located near the first to the third resonance stepped portions 48*a* to 48*c* and 49*a* to 49*c* are formed at the dielectric substrate 11, coupling capacitance of the substrate 11 which extends between the first and the second front end portions 29*a* and 29*b* of the first and the second resonance areas 27 and 28 and the first and the second rear end portions 41 and 43 of the second radiation area 38 can be reduced, so that it is possible to reduce a rate at which heat is dissipated instead of a radio wave being generated, and drastically improve tan δ as an element of radio wave conversion efficiency at the antennas 10F and 10G. As a result of the slits 45*a*, 45*b*, 52*a* and 52*b* or the through holes 46*a*, 46*b*, 53*a* and 53*b* being respectively formed near the radiation stepped portions 42*a* to 42*c*, and 44*a* to 44*c* and the first to the third resonance stepped portions 48*a* to 48*c* and 49*a* to 49*c* at the dielectric substrate 11, the antennas 10F and 10G can increase radiation gains and can emit radio waves farther.

Figure 10:
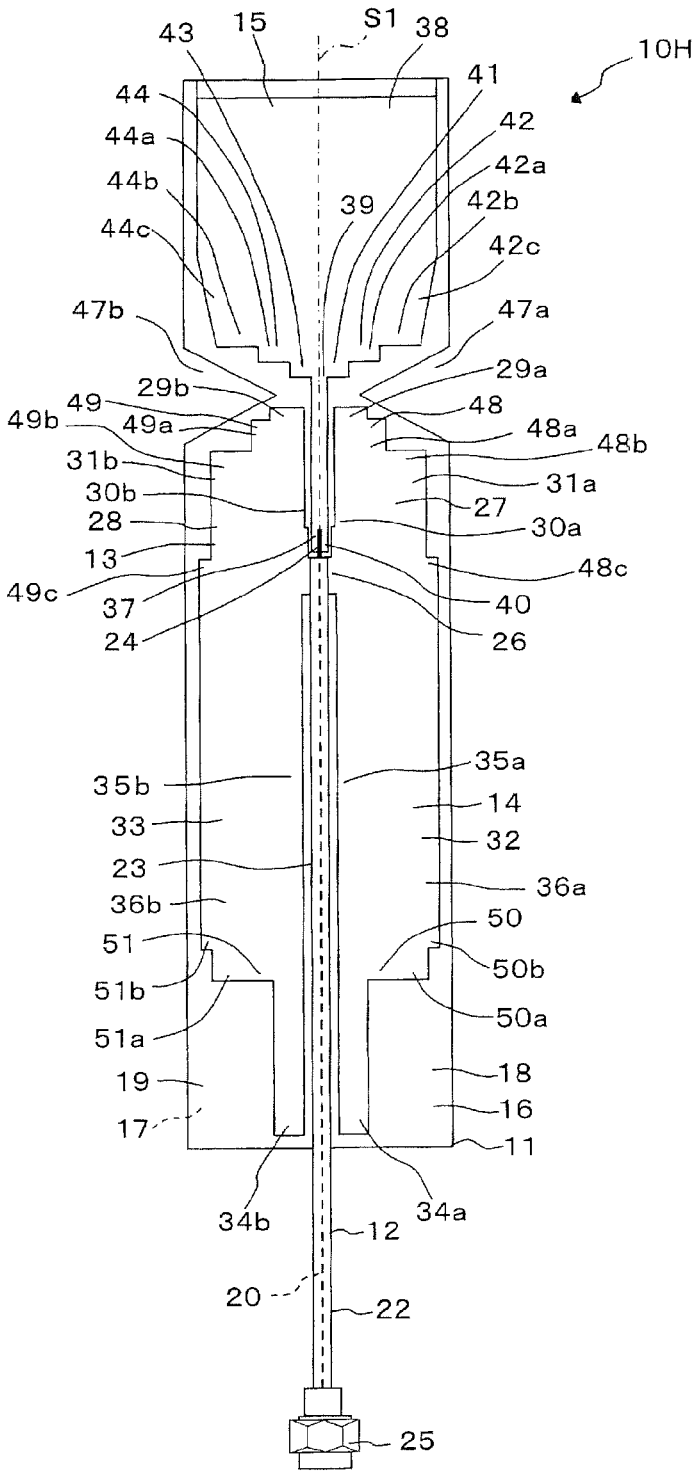
FIG. 10 is a plan view of an antenna illustrated as another example.

FIG. 10 is a plan view of an antenna 10H illustrated as another example. The antenna 10H in FIG. 10 is different from the antennas in FIGS. 7 to 9 in that first and second void portions 47*a* and 47*b* are formed, and because other components of the antenna 10H are the same as those of the antennas 10E to 10G in FIGS. 7 to 9, the same reference numerals as those of the antennas 10E to 10G in FIGS. 7 to 9 are assigned, and explanation of other components of the antenna 10H will be omitted by using explanation of the antennas 10E and 10G. The void portion 47*a* where the dielectric substrate 11 does not exist is formed between the first front end portion 29*a* of the first resonance area 27 and the first rear end portion 41 of the second radiation area 38. The void portion 47*b* where the dielectric substrate 121 does not exist is formed between the second front end portion 29*b* of the second resonance area 28 and the second rear end portion 43 of the second radiation area 38.

The antenna 10H has the following advantageous effects in addition to the advantageous effects of the antennas 10A and 10E in FIGS. 1 and 7. At the antenna 10H, because the first and the second void portions 47*a* and 47*b* where the dielectric substrate 11 does not exist are respectively formed between the first front end portion 29*a* of the first resonance area 27 and the first rear end portion 41 of the second radiation area 38 and between the second front end portion 29*b* of the second resonance area 28 and the second rear end portion 43 of the second radiation area 38, coupling capacitance between the first and the second front end portions 29*a* and 29*b* of the first and the second resonance areas 27 and 28 and the first and the second rear end portions 41 and 43 of the second radiation area 38 can be drastically reduced, so that it is possible to reduce a rate at which heat is dissipated instead of a radio wave being generated, and drastically improve tan δ as an element of radio wave conversion efficiency at the antenna 10H. As a result of the void portions 47*a* and 47*b* being formed, the antenna 10H can increase a radiation gain and can emit a radio wave farther.

Figure 11:
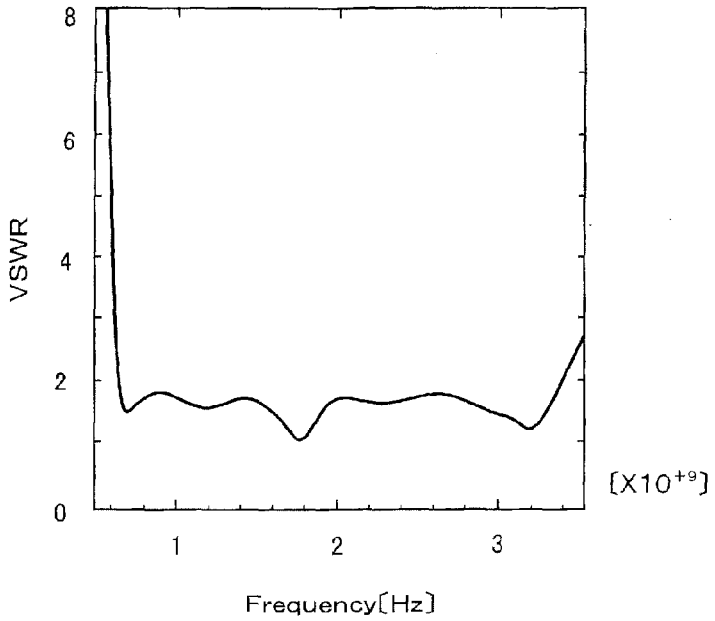
FIG. 11 is a diagram illustrating correlation between a VSWR (voltage standing wave ratio) and a use frequency band.
Figure 12:
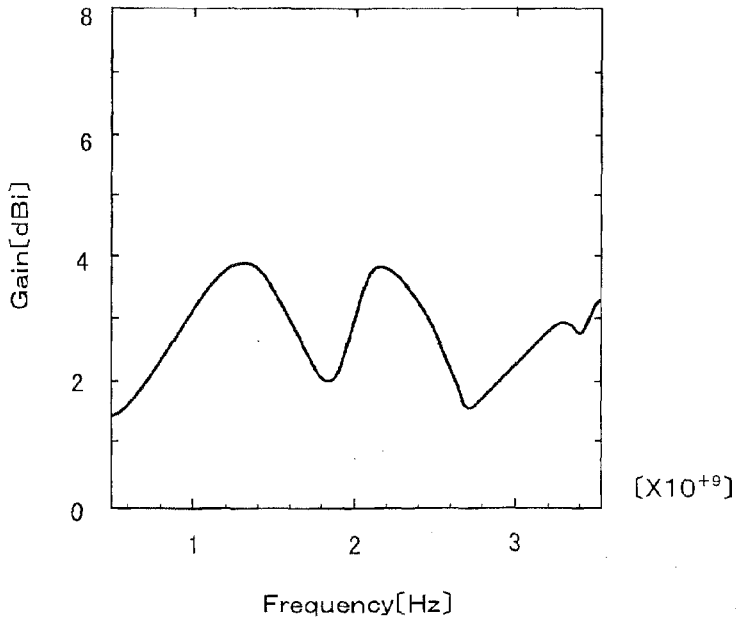
FIG. 12 is a diagram illustrating gain characteristics of the antenna.
Figure 13:
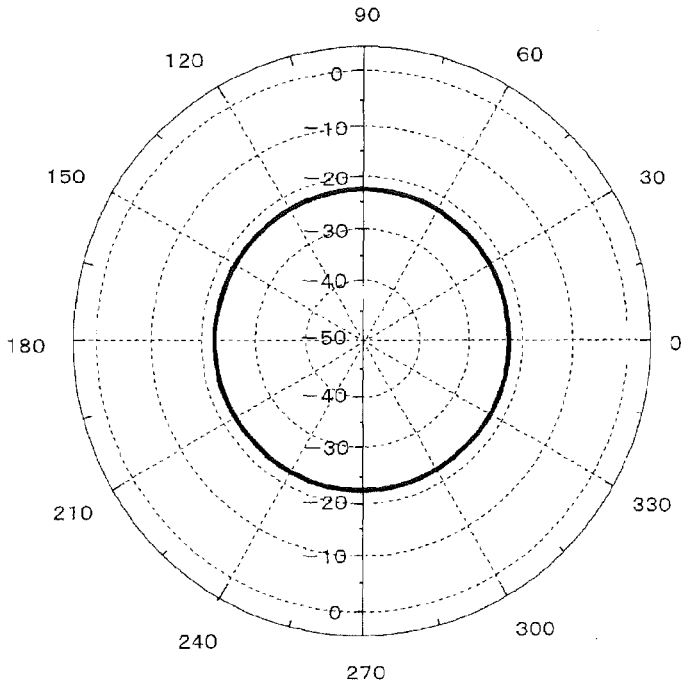
FIG. 13 is a diagram illustrating radio field strength measured in a circumferential direction of three planes of the antenna.
Figure 14:
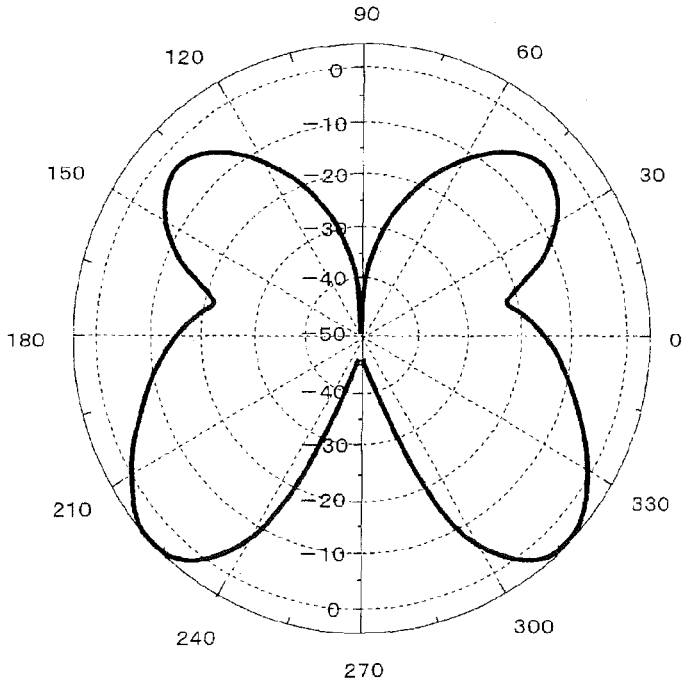
FIG. 14 is a diagram illustrating radio field strength measured in a circumferential direction of three planes of the antenna.
Figure 15:
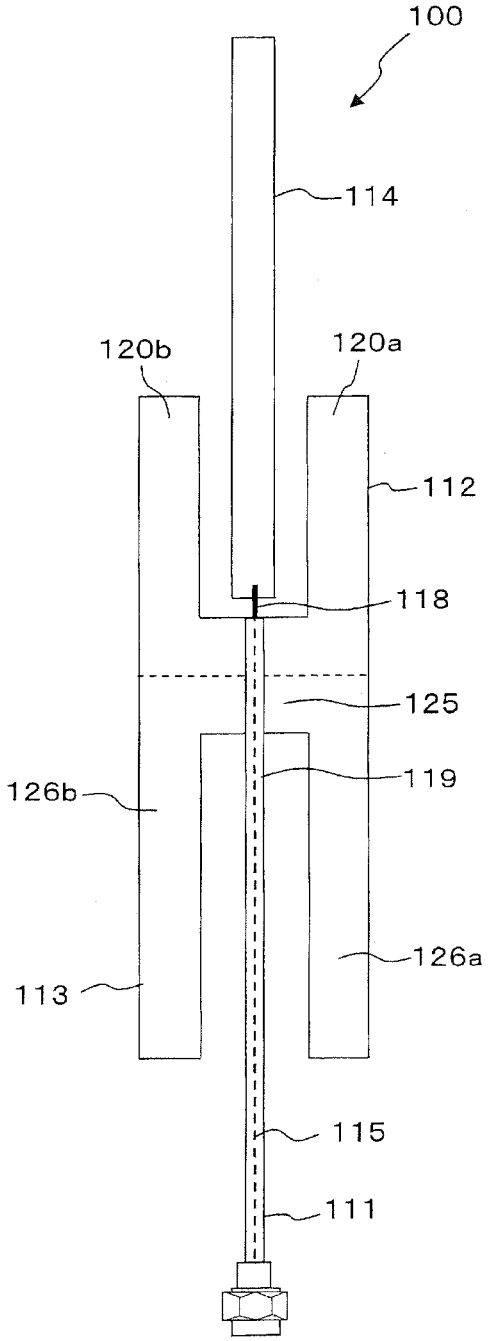
FIG. 15 is a plane view of an antenna according to a conventional technique.

FIG. 11 illustrates correlation between a VSWR (voltage standing wave ratio) and a use frequency band of the antennas 10A to 10H, and FIG. 12 illustrates gain characteristics of the antennas 10A to 10H. FIGS. 13 and 14 illustrate radio field strength measured in a circumferential direction of three planes (an XY plane, a YZ plane and a ZX plane) of the antennas 10A to 10H. FIG. 13 illustrates a measurement result of radio field strength of antenna characteristics of the XY plane in the circumferential direction (0° to 360°), and FIG. 14 illustrates a measurement result of radio field strength of antenna characteristics of the YZ plane or the ZX plane in the circumferential direction (0° to 360°).

As illustrated in FIG. 11, the antennas 10A to 10H has a VSWR (voltage standing wave ratio) of 2 or less in a use frequency of approximately 700 MHz to approximately 3.2 GHz, and it can be understood that the antennas 10A to 10H have a wide use frequency band while maintaining a low VSWR (voltage standing wave ratio). Further, as illustrated in FIG. 12, in the above-described use frequency band, the antennas 10A to 10H can obtain a gain of 2.5 dB or greater. Still further, as illustrated in FIG. 13, radio field strength of the antenna characteristics of the XY plane in the circumferential direction (0° to 360°) are shaped in a substantially true circle, and, as illustrated in FIG. 14, radio field strength of the antenna characteristics of the YZ plane or the ZX plane in the circumferential direction (0° to 360°) are shaped in a butterfly, which indicates that the antennas 10A to 10H have favorable non-directional property.

REFERENCE SIGNS LIST

10A Antenna
10B Antenna
10C Antenna
10D Antenna
10E Antenna

10F Antenna
10G Antenna
10H Antenna
11 Dielectric substrate
12 Unbalanced power supply member
13 Resonance conductor
14 Grounding conductor
15 Radiation conductor
16 Upper face (one face)
17 Lower face
18 First region
19 Second region
20 First conductor
21 Insulating body
22 Second conductor
23 Non-power supply unit
24 Power supply unit
26 Connection area
27 First resonance area
28 Second resonance area
29*a* First front end portion (front end portion)
29*b* Second front end portion (front end portion)
30*a* First inner portion
30*b* Second inner portion
31*a* First outer portion
31*b* Second outer portion
32 First ground area
33 Second ground area
34*a* First rear end portion
34*b* Second rear end portion
35*a* First inner portion
35*b* Second inner portion
36*a* First outer portion
36*b* Second outer portion
37 First radiation area
38 Second radiation area
39 Front end portion
40 Rear end portion
41 First rear end portion
42*a* First radiation stepped portion
42*b* Second radiation stepped portion
42*c* Third radiation stepped portion
43 Second rear end portion
44*a* First radiation stepped portion
44*b* Second radiation stepped portion
44*c* Third radiation stepped portion
45*a* First slit
45*b* Second slit
47*a* Void portion
47*n* Void portion
46*a* First through hole
46B Second through hole
48*a* First resonance stepped portion
48*b* Second resonance stepped portion
48*c* Third resonance stepped portion
49*a* First resonance stepped portion
49*b* Second resonance stepped portion
49*c* Third resonance stepped portion
50*a* First attenuating stepped portion
50*b* Second attenuating stepped portion
51*a* First attenuating stepped portion
51*b* Second attenuating stepped portion
52*a* First slit
52*b* Second slit
53*a* First through hole
53*b* Second through hole
S1 Central axial line

The invention claimed is:

1. An antenna comprising:

a dielectric substrate having predetermined permittivity and having first and second regions sectioned by a central axial line dividing a width dimension;

an unbalanced power supply member located on the central axial line and having a non-power supply unit and a power supply unit, the non-power supply unit extending in an axial direction and having predetermined length, and the power supply unit extending forward in the axial direction from the non-power supply unit;

a resonance conductor molded into a plate shape having a predetermined area and fixed on one face of the dielectric substrate;

a grounding conductor molded into a plate shape having a predetermined area, fixed on one face of the dielectric substrate and continuously coupled to the resonance conductor; and a radiation conductor molded into a plate shape having a predetermined area, fixed on one face of the dielectric substrate, and electrically connected to the power supply unit, wherein the resonance conductor comprises:

a connection area electrically connected to the unbalanced power supply member;

a first resonance area coupled to the connection area, located in a first region of the dielectric substrate, and extending in the axial direction while separating outward in a width direction from the unbalanced power supply member by a predetermined dimension; and a second resonance area coupled to the connection area, located in a second region of the dielectric substrate, and extending in the axial direction while separating outward in the width direction from the unbalanced power supply member by a predetermined dimension, the grounding conductor comprises:

a first ground area located in the first region of the dielectric substrate, and extending backward in the axial direction from the first resonance area while separating outward in the width direction from the unbalanced power supply member by a predetermined dimension; and a second ground area located in the second region of the dielectric substrate, and extending backward in the axial direction from the second resonance area while separating outward in the width direction from the unbalanced power supply member by a predetermined dimension, the radiation conductor comprises:

a first radiation area located between the first and the second resonance areas and extending forward in the axial direction from the connection area of the resonance conductor, a rear end portion of the first radiation area being connected to the power supply unit; and a second radiation area extending forward in the axial direction from a front end portion of the first radiation area, a width dimension of the second radiation area being greater than a width dimension of the first radiation area, a plurality of radiation stepped portions denting stepwise forward in the axial direction toward outward in the width direction from the central axial line are formed at a first rear end portion of the second radiation area, facing the front end portion of the first resonance area, and a plurality of radiation stepped portions denting stepwise forward in the axial direction toward outward in the width direction from the central axial line are formed at a second rear end portion of the second radiation area, facing a front end portion of the second resonance area.

2. The antenna according to claim 1, wherein the radiation stepped portions formed at the first rear end portion of the second radiation area and the radiation stepped portions formed at the second rear end portion of the second radiation area comprise:

a first radiation stepped portion located at a side of the central axial line and denting forward in the axial direction from the first and second rear end portions;

a second radiation stepped portion located outward in a width direction of the first radiation stepped portion and denting forward in the axial direction from the first radiation stepped portion; and a third radiation stepped portion located outward in a width direction of the second radiation stepped portion and tilting so as to gradually separate from the central axial line.

3. The antenna according to claim 1, wherein a plurality of resonance stepped portions denting stepwise backward in the axial direction toward outward in the width direction from the central axial line are formed at the front end portion of the first resonance area, and a plurality of resonance stepped portions denting stepwise backward in the axial direction toward outward in the width direction from the central axial line are formed at the front end portion of the second resonance area.

4. The antenna according to claim 3, wherein the resonance stepped portions formed at the front end portion of the first resonance area and the resonance stepped portions formed at the front end portion of the second resonance area comprise:

a first resonance stepped portion located at a side of the central axial line and denting backward in the axial direction from the front end portions of the resonance areas;

a second resonance stepped portion located outward in a width direction of the first resonance stepped portion and denting backward in the width direction from the first resonance stepped portion; and a third resonance stepped portion located outward in a width direction of the second resonance stepped portion and denting backward in the axial direction from the second resonance stepped portion.

5. The antenna according to claim 1, wherein a plurality of attenuating stepped portions denting stepwise forward in the axial direction toward outward in the width direction from the central axial line are formed at a rear end portion of the first ground area, and a plurality of attenuating stepped portions denting stepwise forward in the axial direction toward outward in the width direction from the central axial line are formed at the rear end portion of the second ground area.

6. The antenna according to claim 5, wherein the attenuating stepped portions formed at the rear end portion of the first ground area and the attenuating stepped portions formed at the rear end portion of the second ground area comprise:

a first attenuating stepped portion located at a side of the central axial line and denting forward in the axial direction from the rear end portions of the resonance areas; and a second attenuating stepped portion located outward in a width direction of the first attenuating stepped portion and denting forward in the axial direction from the first attenuating stepped portion.

7. The antenna according to claim 1, wherein at the dielectric substrate extending between the front end portion of the first resonance area and the first rear end portion of the second radiation area, a first slit located near the radiation stepped portions and extending so as to gradually separate from the central axial line toward forward in the axial direction is formed, or a plurality of first through holes located near the radiation stepped portions and aligned so as to gradually separate from the central axial line toward forward in the axial direction are formed, and at the dielectric substrate extending between the front end portion of the second resonance area and the second rear end portion of the second radiation area, a second slit located near the radiation stepped portions and extending so as to gradually separate from the central axial line toward forward in the axial direction is formed, or a plurality of second through holes located near the radiation stepped portions and aligned so as to gradually separate from the central axial line toward forward in the axial direction are formed.

8. The antenna according to claim 3, wherein at the dielectric substrate extending between the front end portion of the first resonance area and the first rear end portion of the second radiation area, a third slit located near the resonance stepped portions and extending so as to gradually separate from the central axial line toward backward in the axial direction is formed, or a plurality of third through holes located near the resonance stepped portions and aligned so as to gradually separate from the central axial line toward backward in the axial direction are formed, and at the dielectric substrate extending between the front end portion of the second resonance area and the second rear end portion of the second radiation area, a fourth slit located near the resonance stepped portions and extending so as to gradually separate from the central axial line toward backward in the axial direction is formed, or a plurality of fourth through holes located near the resonance stepped portions and aligned so as to gradually separate from the central axial line toward backward in the axial direction are formed.

9. The antenna according to claim 1, wherein a first void portion where the dielectric substrate does not exist is formed between the front end portion of the first resonance area and the first rear end portion of the second radiation area, and a second void portion where the dielectric substrate does not exist is formed between the front end portion of the second resonance area and the second rear end portion of the second radiation area.

10. The antenna according to claim 1, wherein the first resonance area located in the first region and the second resonance area located in the second region are symmetric with respect to the central axial line, the first ground area located in the first region and the second ground area located in the second region are symmetric with respect to the central axial line, and the first and the second radiation areas located in the first region and the first and the second radiation areas located in the second region are symmetric with respect to the central axial line.

11. The antenna according to claim 1, wherein the unbalanced power supply member is formed with a first conductor extending in the axial direction, an insulator covering an outer periphery of the first conductor, and a second conductor covering an outer periphery of the insulator and extending in the axial direction, the non-power supply unit is formed with the first and the second conductors and the insulator, the power supply unit is formed with the first conductor, and the connection area of the resonance conductor is electrically connected to the second conductor.

12. The antenna according to claim 1, wherein a length dimension in the axial direction of the grounding conductor falls within a range between 10 and 15 cm, and is set at length of approximately ¼ wavelength of 700 MHz.

* * * * *